US012768158B2

(12) United States Patent
Lin et al.

(10) Patent No.: US 12,768,158 B2
(45) Date of Patent: Oct. 20, 2026

(54) WALL-MOUNTED TOILET SYSTEM

(71) Applicant: QUANZHOU KOMOO INTELLIGENT KITCHEN & BATH CO., LTD., Nan'an (CN)

(72) Inventors: Xiaofa Lin, Nan'an (CN); Xiaoshan Lin, Nan'an (CN); Shan Lin, Nan'an (CN); Rongrong Xu, Nan'an (CN); Zhida Chen, Nan'an (CN)

(73) Assignee: Quanzhou Komoo Intelligent Kitchen & Bath Co., Ltd., Na'an (CN)

( * ) Notice: Subject to any disclaimer, the term of this patent is extended or adjusted under 35 U.S.C. 154(b) by 183 days.

(21) Appl. No.: 18/833,869

(22) PCT Filed: Dec. 19, 2022

(86) PCT No.: PCT/CN2022/140112
§ 371 (c)(1),
(2) Date: Jul. 26, 2024

(87) PCT Pub. No.: WO2024/031908
PCT Pub. Date: Feb. 15, 2024

(65) Prior Publication Data

US 2025/0146264 A1 May 8, 2025

(30) Foreign Application Priority Data

Aug. 12, 2022 (CN) ..... 202210970381.0

(51) Int. Cl.
*E03D 11/14* (2006.01)

(52) U.S. Cl.
CPC ..... *E03D 11/143* (2013.01)

(58) Field of Classification Search
CPC ..... E03D 11/10; E03D 11/125; E03D 11/14–146; E03D 11/17
See application file for complete search history.

(56) References Cited

U.S. PATENT DOCUMENTS

| | | | | |
|---|---|---|---|---|
| 11,987,970 | B2 * | 5/2024 | Priborsky | F16L 27/0861 |
| 2020/0018055 | A1 | 1/2020 | Garrels et al. | |
| 2021/0123225 | A1 | 4/2021 | Bissell | |

FOREIGN PATENT DOCUMENTS

| | | | |
|---|---|---|---|
| CN | 205822402 | U | 12/2016 |
| CN | 207620071 | U | 7/2018 |

(Continued)

OTHER PUBLICATIONS

Office Action for CN Application No. 202210970381.0, dated Aug. 21, 2025, pp. 1-16.

(Continued)

*Primary Examiner* — David P Angwin
*Assistant Examiner* — Nicholas A Ros
(74) *Attorney, Agent, or Firm* — Foley & Lardner LLP

(57) ABSTRACT

A wall-mounted toilet system, comprising: a wall-mounted bracket (1) and an in-wall drain pipe (2); a toilet body (3), which is fixed to the wall-mounted bracket (1) and has a bowl (31) and a mounting cavity (32); and a drain device (4), which is connected to the toilet body (3), communicates with the in-wall drain pipe (2), and comprises a rotary drain pipe (41) arranged in the mounting cavity (32), wherein one end of the rotary drain pipe (41) communicates with the bowl (31), and is configured to rotate relative to the toilet body (3) between an initial position and a drain position, such that when the rotary drain pipe rotates to the initial position, a water seal is formed in the bowl (31); and when the rotary drain pipe rotates to the drain position, dirt in the bowl (31) is discharged into the in-wall drain pipe (2).

18 Claims, 16 Drawing Sheets

(56) References Cited

FOREIGN PATENT DOCUMENTS

| | | | | | |
|---|---|---|---|---|---|
| CN | 212689116 | U | | 3/2021 | |
| CN | 113983331 | A | | 1/2022 | |
| CN | 114134970 | A | | 3/2022 | |
| CN | 114411907 | A | | 4/2022 | |
| CN | 114411908 | A | | 4/2022 | |
| CN | 114411909 | A | | 4/2022 | |
| CN | 114457888 | | * | 5/2022 | ..... E03D 11/00 |
| CN | 114457888 | A | | 5/2022 | |
| CN | 216515964 | U | | 5/2022 | |
| CN | 216948602 | U | | 7/2022 | |
| CN | 115404964 | A | | 11/2022 | |
| CN | 218176033 | U | | 12/2022 | |
| CN | 218176041 | U | | 12/2022 | |
| EP | 1813733 | | * | 8/2007 | ..... E03D 11/143 |
| EP | 1813733 | A2 | | 8/2007 | |
| EP | 2642034 | | * | 9/2013 | ..... E03D 11/146 |
| EP | 3 754 123 | A1 | | 12/2020 | |
| JP | H06-240729 | A | | 8/1994 | |
| JP | 2001-073437 | A | | 3/2001 | |
| JP | 2005-213765 | A | | 8/2005 | |
| JP | 2005-325658 | A | | 11/2005 | |
| JP | 2009-074364 | A | | 4/2009 | |
| JP | 2010-150920 | A | | 7/2010 | |
| JP | 2010150920 | | * | 7/2010 | ..... E03D 11/02 |
| JP | 2013-002153 | A | | 1/2013 | |
| JP | 2015-190256 | A | | 11/2015 | |
| JP | 2017-133288 | A | | 8/2017 | |
| JP | 2017-160647 | A | | 9/2017 | |
| JP | 2022-041175 | A | | 3/2022 | |

OTHER PUBLICATIONS

Office Action for JP Application No. 2024-547466, dated Oct. 7, 2025, pp. 1-16.

Office Action for KR Application No. 10-2024-7026406, dated Aug. 8, 2025, pp. 1-17.

EP Search Report for EP Application No. 22954846.6, dated May 26, 2025, pp. 1-11.

Office Action for CN Application No. 2022109703810, dated Apr. 25, 2025, pp. 1-18.

International Search Report and Written Opinion for PCT Application No. PCT/CN2022/140112, dated Apr. 19, 2023.

Office Action for JP Application No. 2024-54766, dated Apr. 7, 2026.

Office Action for KR Application No. 10-2024-7026406, dated Jun. 13, 2026.

* cited by examiner

WALL-MOUNTED TOILET SYSTEM

CROSS-REFERENCE TO RELATED APPLICATIONS

The present application is a U.S. National Phase Entry of International Application No. PCT/CN2022/140112 having an international filing date of Dec. 19, 2022, which claims priority of Chinese Patent Application No. 202210970381.0, filed to the CNIPA on Aug. 12, 2022 and entitled "Wall-Mounted Toilet System". Contents of the above-identified applications should be regarded as being incorporated herein by reference.

TECHNICAL FIELD

The present disclosure relates to, but is not limited to, sanitary ware technology, and in particular relates to a wall-mounted toilet system.

BACKGROUND

Generally, a fake wall is built behind a wall-mounted toilet, and the wall-mounted bracket and water tank are buried in the fake wall. Because the water tank is embedded, the quality requirements are very high, and the price is relatively higher. Moreover, when problems such as water tank leakage and water pipe rupture occur, the fake wall needs to be broken before maintenance can be carried out, resulting in troublesome maintenance and longer working hours.

SUMMARY

The following is a summary of the subject matter described in detail herein. This summary is not intended to limit the protection scope of the claims.

An embodiment of the present disclosure provides a wall-mounted toilet system, including: a wall-mounted bracket and an in-wall drain pipe; a toilet body, which is fixed to the wall-mounted bracket and is provided with a bowl and a mounting cavity; and a drain device, which is connected to the toilet body, communicates with the in-wall drain pipe, and includes a rotary drain pipe provided within the mounting cavity, wherein one end of the rotary drain pipe communicates with the bowl, and the rotary drain pipe is configured to rotate relative to the toilet body between an initial position and a drain position, such that when the rotary drain pipe rotates to the initial position, a water seal is formed in the bowl, and when the rotary drain pipe rotates to the drain position, sewage in the bowl is discharged into the in-wall drain pipe.

Other aspects may be understood upon reading and understanding the drawings and detailed description.

BRIEF DESCRIPTION OF DRAWINGS

Accompanying drawings are used for providing understanding of technical solutions of the present disclosure, and form a part of the specification. They are used for explaining the technical solutions of the present disclosure together with the embodiments of the present disclosure, but do not form a limitation on the technical schemes of the present disclosure.

DRAWING REFERENCE SIGNS ARE AS FOLLOWS

Figure 1:
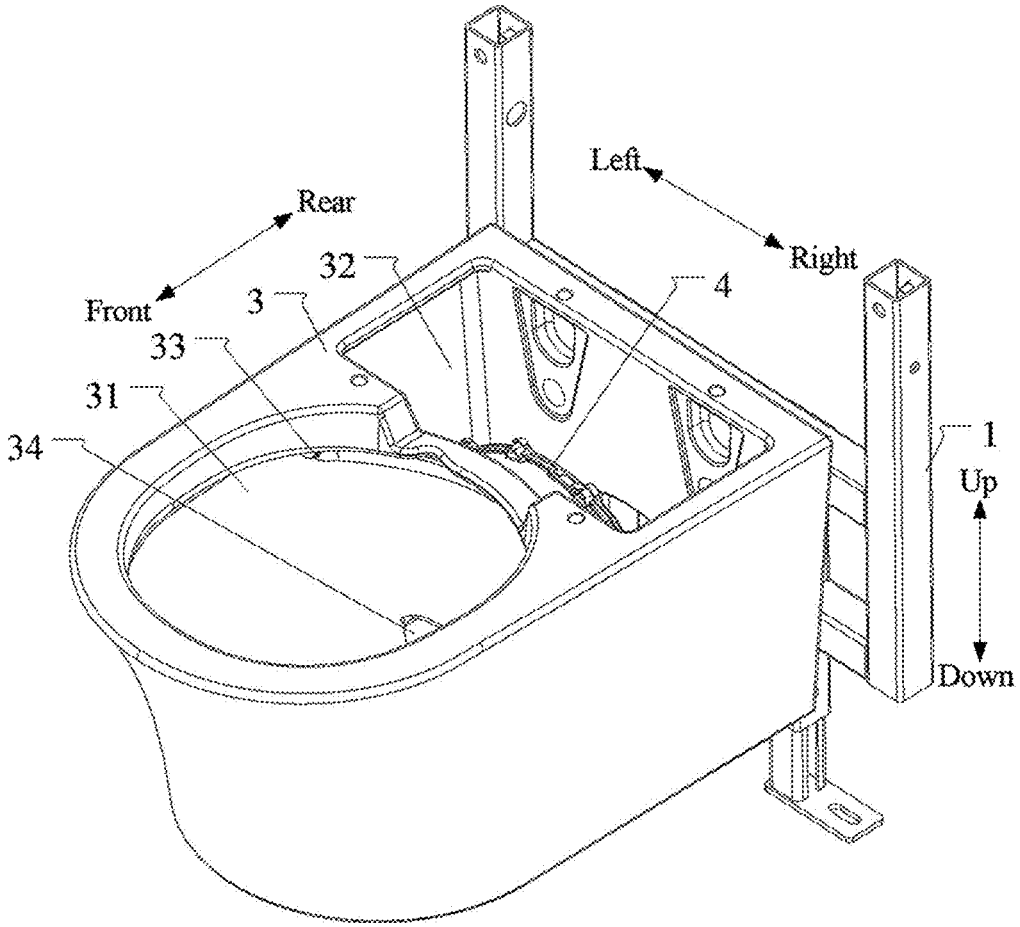
FIG. 1 is a schematic diagram of a partial (toilet lid omitted) three-dimensional structure of a wall-mounted toilet system provided by an embodiment of the present disclosure.
Figure 2:
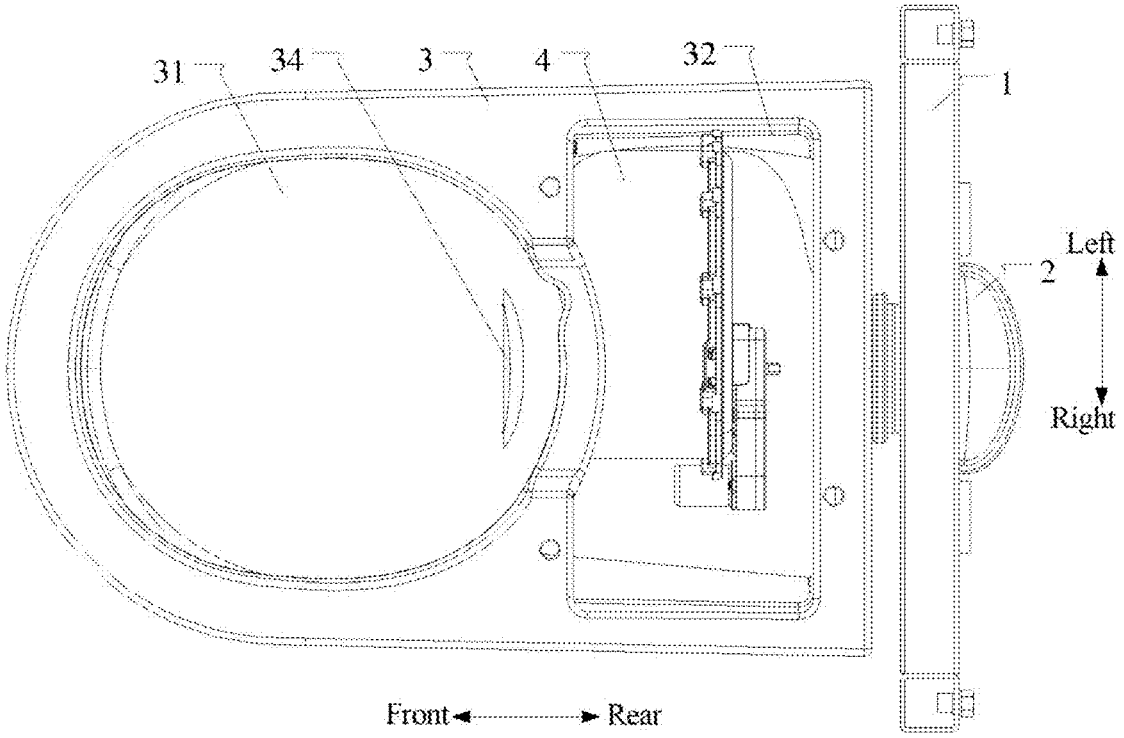
FIG. 2 is a schematic top view of a structure of the wall-mounted toilet system shown in FIG. 1.
Figure 3:
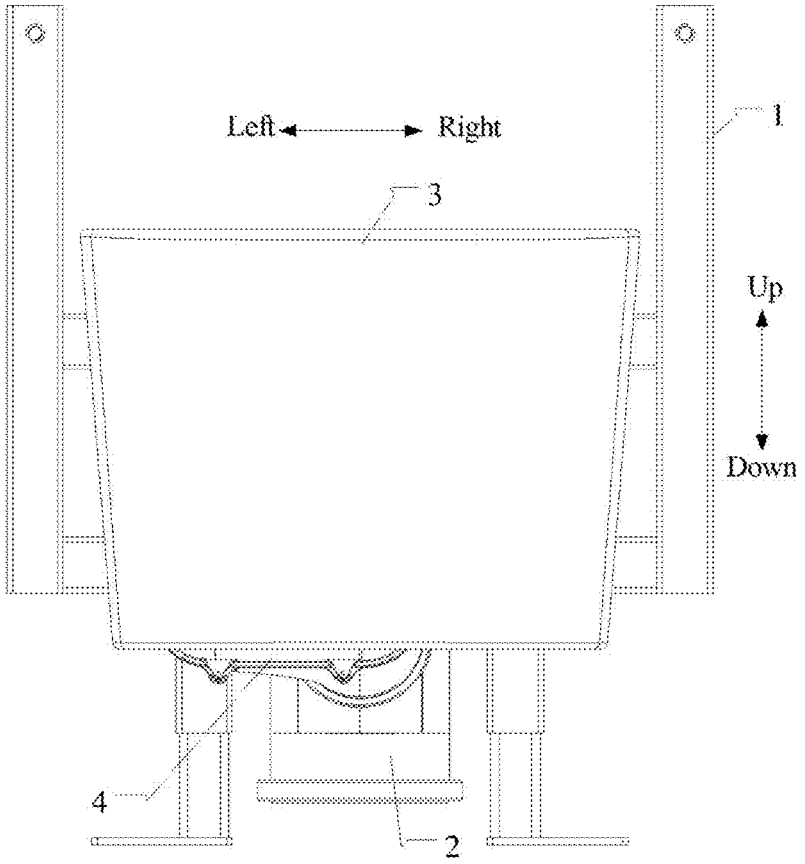
FIG. 3 is a schematic front view of a structure of the wall-mounted toilet system shown in FIG. 1.
Figure 4:
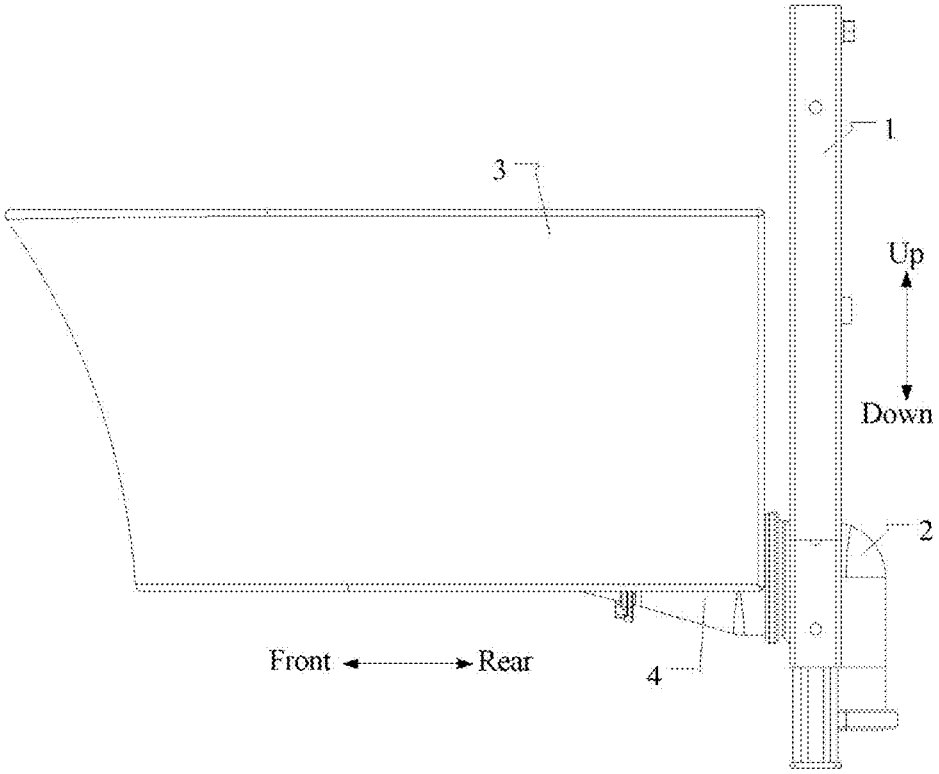
FIG. 4 is a schematic right view of a structure of the wall-mounted toilet system shown in FIG. 1.
Figure 5:
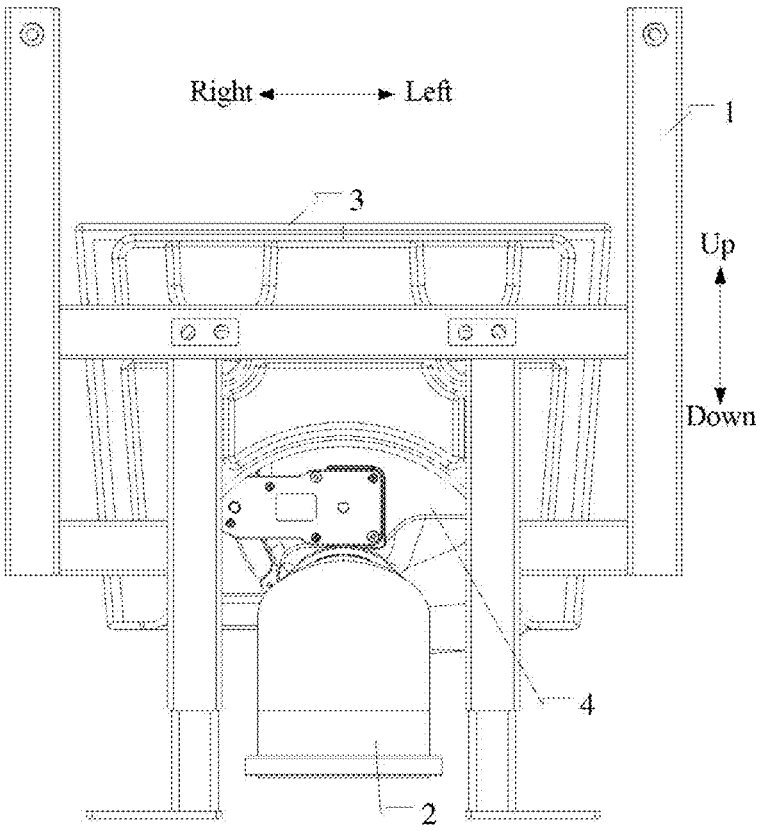
FIG. 5 is a schematic rear view of a structure of the wall-mounted toilet system shown in FIG. 1.
Figure 6:
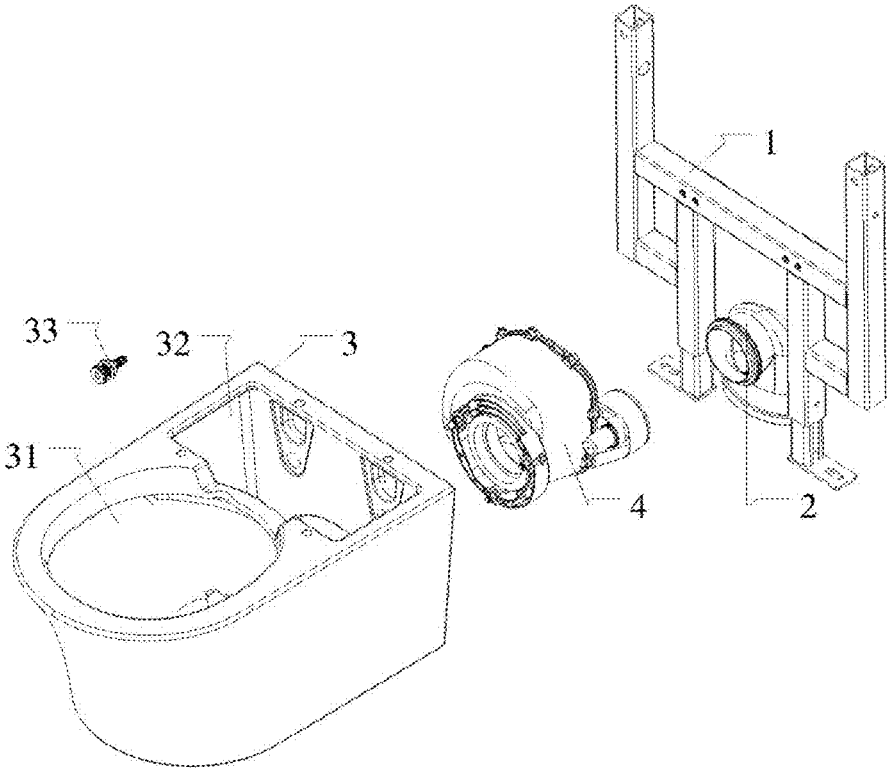
FIG. 6 is a schematic diagram of an exploded structure of the wall-mounted toilet system shown in FIG. 1.

1 wall-mounted bracket, 11 bracket body, 111 fixing frame, 1111 third vertical support arm, 1112 fourth vertical support arm, 1113 first support plate, 1114 second support plate, 1115 first connection hole, 1116 first vertical plate, 1117 second vertical plate, 1118 third vertical plate, 1119 fourth vertical plate, 112 movable frame, 1121 first vertical support arm, 1122 second vertical support arm, 1123 transverse support arm, 1124 first stiffening portion, 1125 second stiffening portion, 1126 bolt hole, 1127 second connection hole, 1128 adjustment hole, 1131 first fastener, 1132 second fastener, 12 foot expansion bolt, 13 fixing bolt;

2 in-wall drain pipe;

3 toilet body, 31 bowl, 32 mounting cavity, 33 water outlet, 34 first sewage outlet;

4 drain device, 41 rotary drain pipe, 411 connection portion, 42 drain box, 421 box body, 4211 rotary connection hole, 4212 fixing portion, 422 box cover, 4221 second sewage outlet, 4222 connection hole, 423 extension pipe, 424 drain cavity, 425 first region, 4251 transition region, 4252 expansion region, 426 second region, 43 driving device, 44 sealing ring, 45 oil seal, 46 interface; and

51 wall, 52 floor.

DETAILED DESCRIPTION

Embodiments of the present disclosure will be described in detail with reference to the accompanying drawings. The embodiments in the present disclosure and the features in the embodiments may be combined with each other arbitrarily if there is no conflict.

As shown in FIGS. 1 to 7, embodiments of the present disclosure provide a wall-mounted toilet system, including a wall-mounted bracket 1, an in-wall drain pipe 2, a toilet body 3, and a drain device 4.

The toilet body 3 is fixed to the wall-mounted bracket 1. The toilet body 3 is provided with a bowl 31 and a mounting cavity 32. The drain device 4 is connected to the toilet body 3 and communicates with the in-wall drain pipe 2. The drain device 4 includes a rotary drain pipe 41 provided in the mounting cavity 32. One end of the rotary drain pipe 41 communicates with the bowl 31, and the rotary drain pipe 41 is configured to rotate relative to the toilet body 3 between an initial position and a drain position, such that when the rotary drain pipe 41 rotates to the initial position, a water seal is formed in the bowl 31, and when the rotary drain pipe 41 rotates to the drain position, sewage in the bowl 31 is discharged into the in-wall drain pipe 2.

The wall-mounted toilet system provided by an embodiment of the present disclosure includes a wall-mounted bracket 1, an in-wall drain pipe 2, a toilet body 3, and a drain device 4. A rear end face of the toilet body 3 is fixed to the wall-mounted bracket 1, the wall-mounted bracket 1 and the in-wall drain pipe 2 may be buried in the fake wall, and the drain device 4 is mounted to the toilet body 3 and communicates with the in-wall drain pipe 2, thereby realizing the on-wall mounting of the toilet. The in-wall drain pipe 2 is mounted in the wall and discharges sewage into a public sewage channel. The mounting cavity 32 of the toilet body 3 is used for mounting a structure such as the drain device 4.

Figure 8:
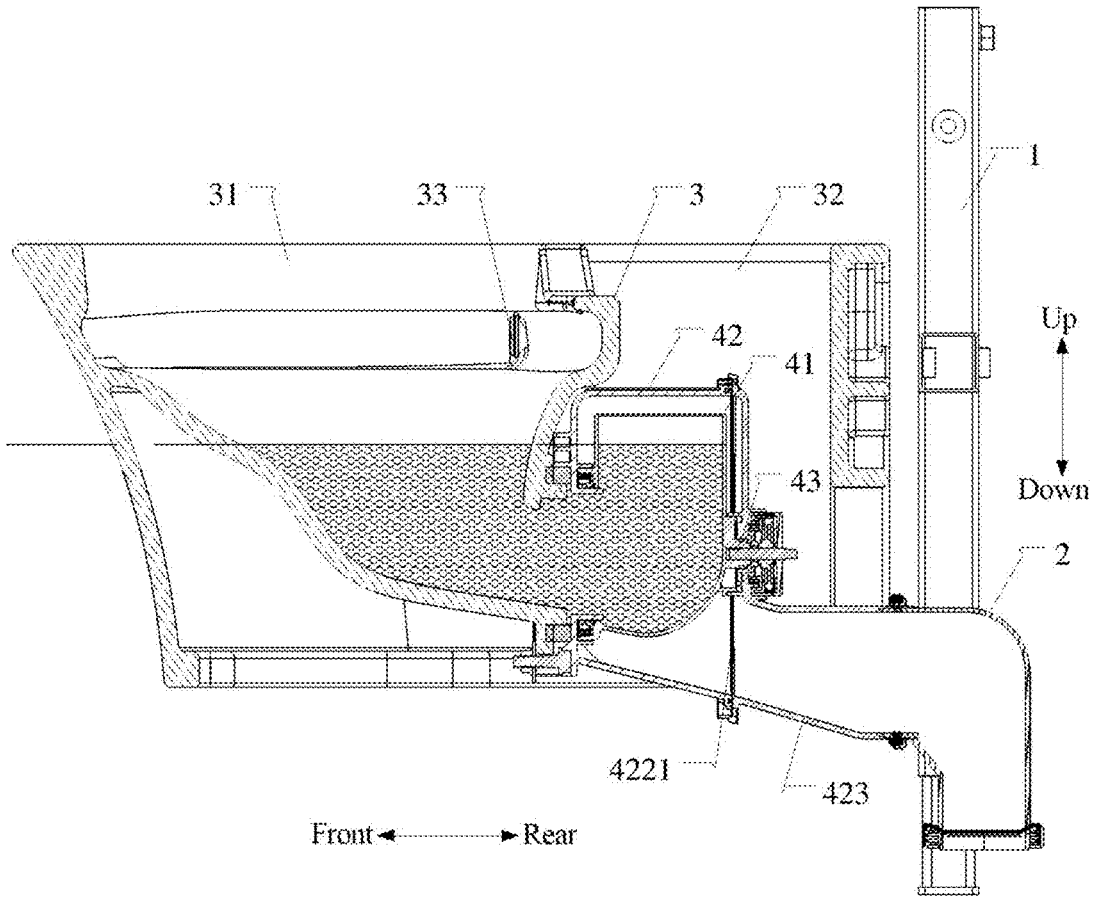
FIG. 8 is a schematic diagram of a cross-sectional structure of the wall-mounted toilet system shown in FIG. 1 in a standby state.
Figure 9:
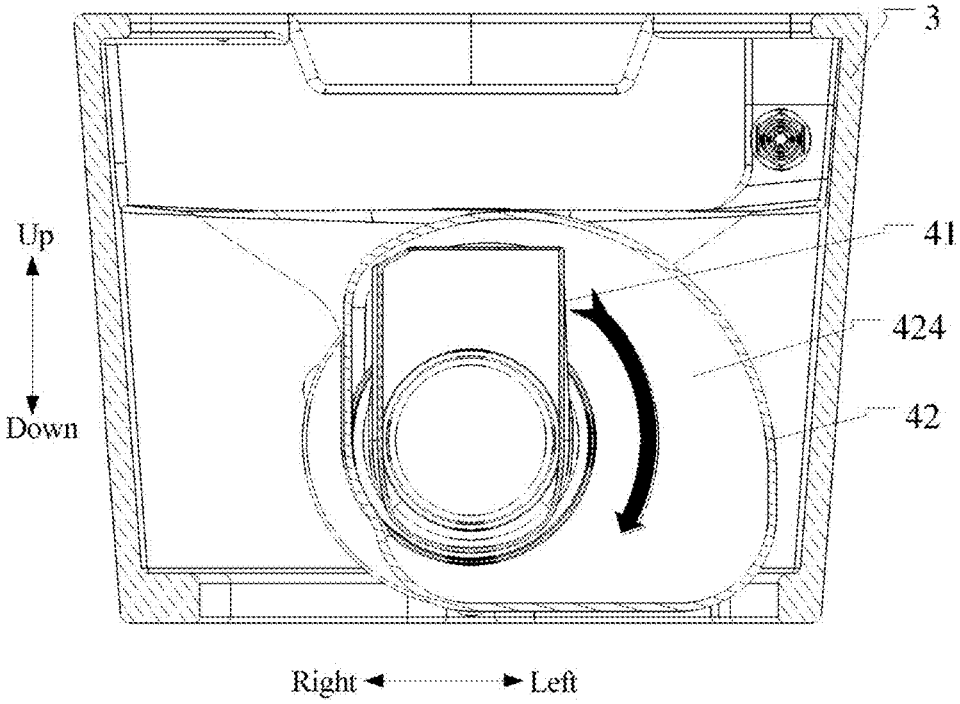
FIG. 9 is a schematic diagram of a cross-sectional structure of the wall-mounted toilet system shown in FIG. 1 in a first state.
Figure 10:
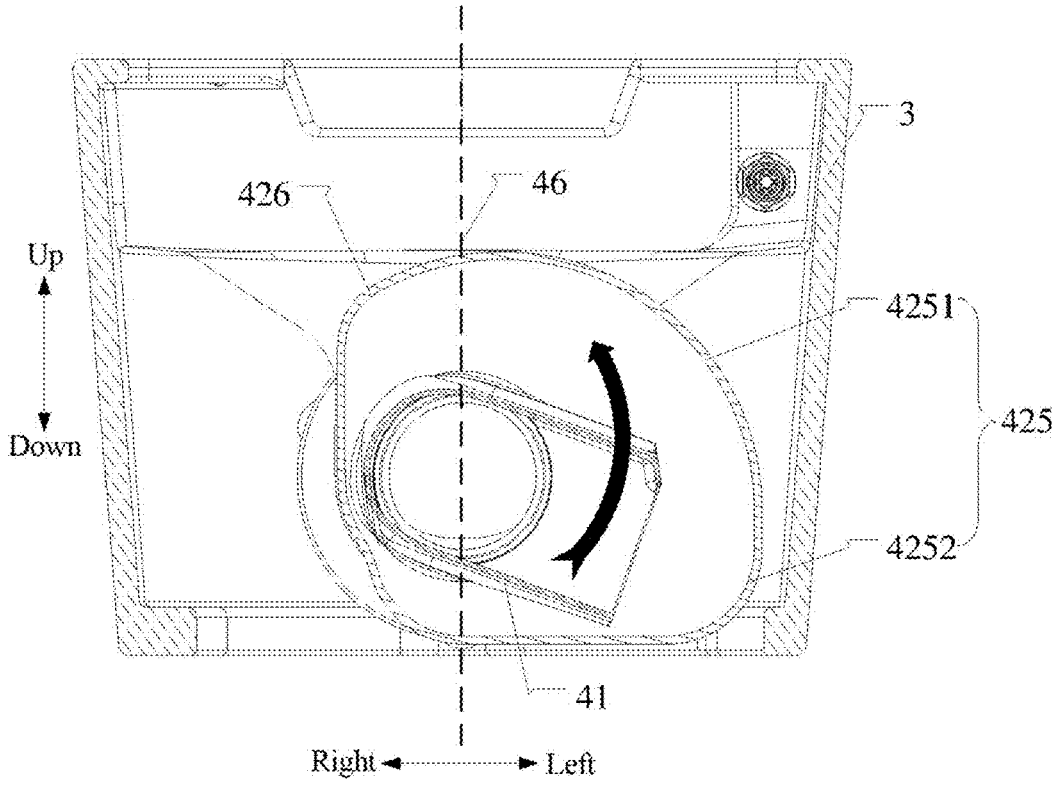
FIG. 10 is a schematic diagram of a cross-sectional structure of the wall-mounted toilet system shown in FIG. 1 in a second state.
Figure 11:
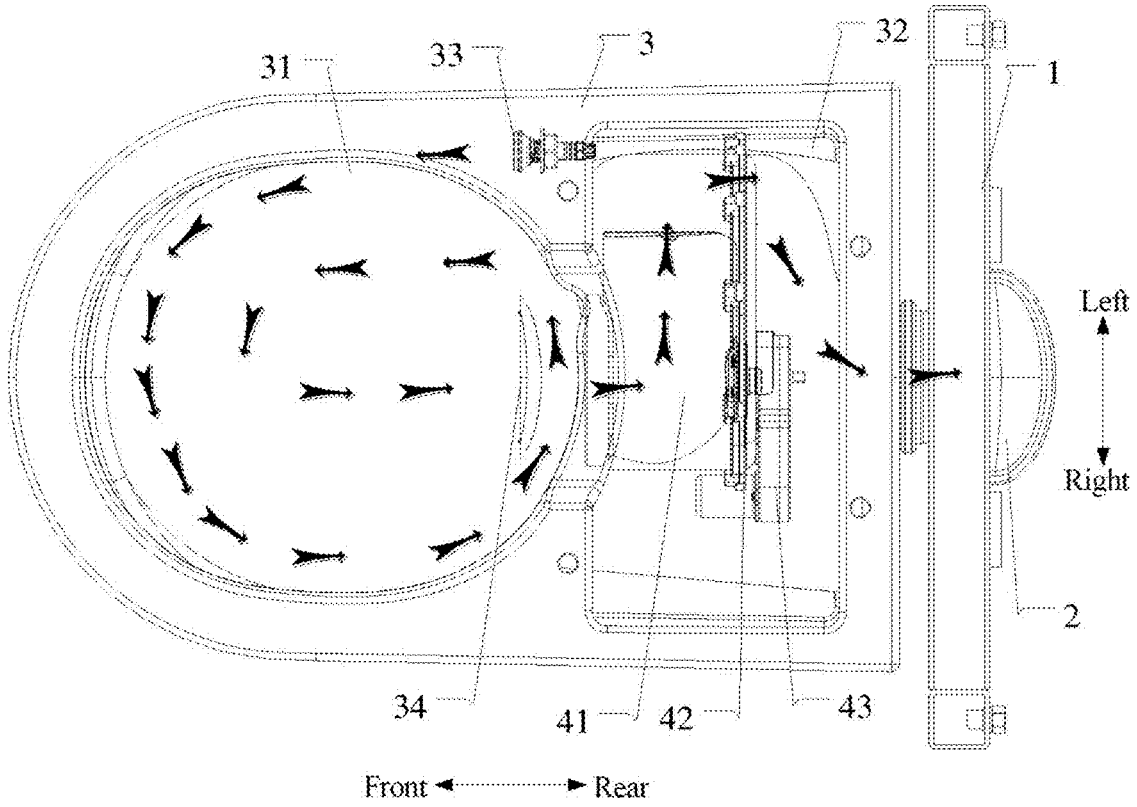
FIG. 11 is a schematic top view of a structure of the wall-mounted toilet system shown in FIG. 1 in a drain state.

The drain device 4 is connected to the toilet body 3, communicates with the in-wall drain pipe 2, and is used for discharging the sewage in the bowl 31 into the in-wall drain pipe 2 to realize the sewage discharging function. The sewage discharging principle is that in the standby state, as shown in FIGS. 8 and 9, the rotary drain pipe 41 is located in the initial position, and a water seal is formed in the bowl 31. When it is needed to discharge sewage, the rotary drain pipe 41 rotates downwards, and the sewage in the bowl 31 and the rotary drain pipe 41 flows downwards under the action of gravity, and is discharged into the in-wall drain pipe 2 through the rotary drain pipe 41, as shown in FIGS. 10 and 11. Therefore, the present scheme utilizes the gravitational potential energy of water and the turnover of the rotary drain pipe 41 to realize the sewage discharging function. Compared with the conventional scheme in which the sewage is flushed into the in-wall drain pipe 2 by spraying high-pressure water flow opposite a first sewage outlet 34 of the toilet body 3, the present scheme may effectively reduce the flushing noise during the sewage discharging process, and improve the user experience. Moreover, injection port, water tank, pressurization device and other structures in the conventional scheme may be omitted, thereby reducing the product cost and simplifying the mounting process. Since the water tank is omitted, weight and size of the wall-mounted toilet system are greatly reduced, and the wall-mounted bracket 1 may also be correspondingly shorter and smaller, which is conducive to saving raw materials for the wall-mounted bracket 1 and reducing the production cost of the wall-mounted bracket 1.

Moreover, since the drain device 4 may be mounted in the mounting cavity 32, and the toilet body 3 does not need to be mounted in the wall, it is different from the scheme of traditional wall-mounted toilet that requires a flushing system to be buried in the fake wall. Therefore, there is no need to remove the fake wall during maintenance, cleaning and other operations, and the maintenance operation is relatively convenient.

The toilet body 3 may be made of ceramic. Alternatively, it may also be made of stainless steel or other materials.

In an exemplary embodiment, the mounting cavity 32 is located between the bowl 31 and the wall-mounted bracket 1.

In other words, the mounting cavity 32 of the toilet body 3 is located on a rear side of the bowl 31. In this way, the drain device 4 is also located on the rear side of the bowl 31, which is convenient to directly discharge the sewage back into the in-wall drain pipe 2.

Figure 13:
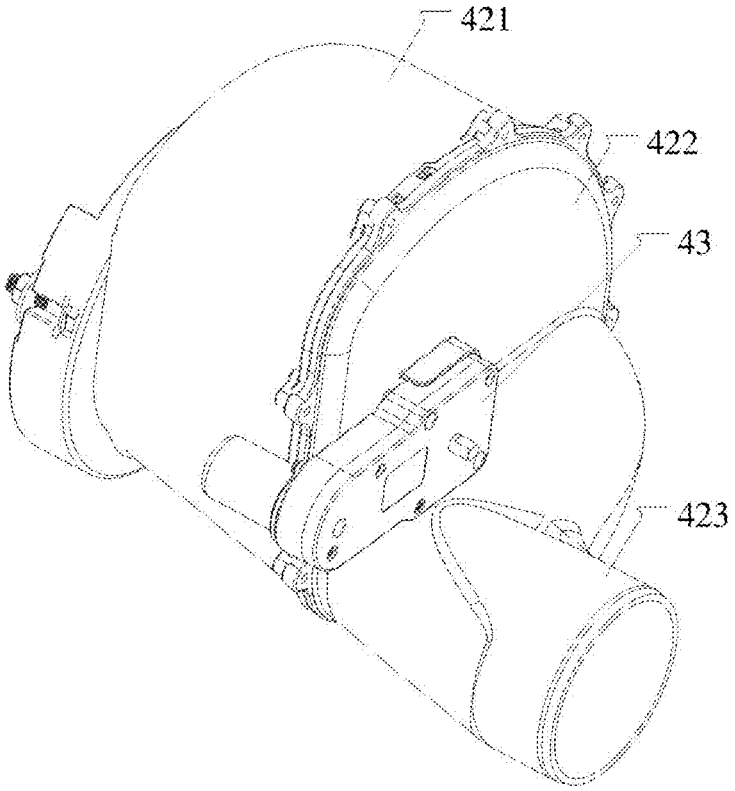
FIG. 13 is a schematic diagram of a three-dimensional structure of a drain device of the wall-mounted toilet system shown in FIG. 1.
Figure 14:
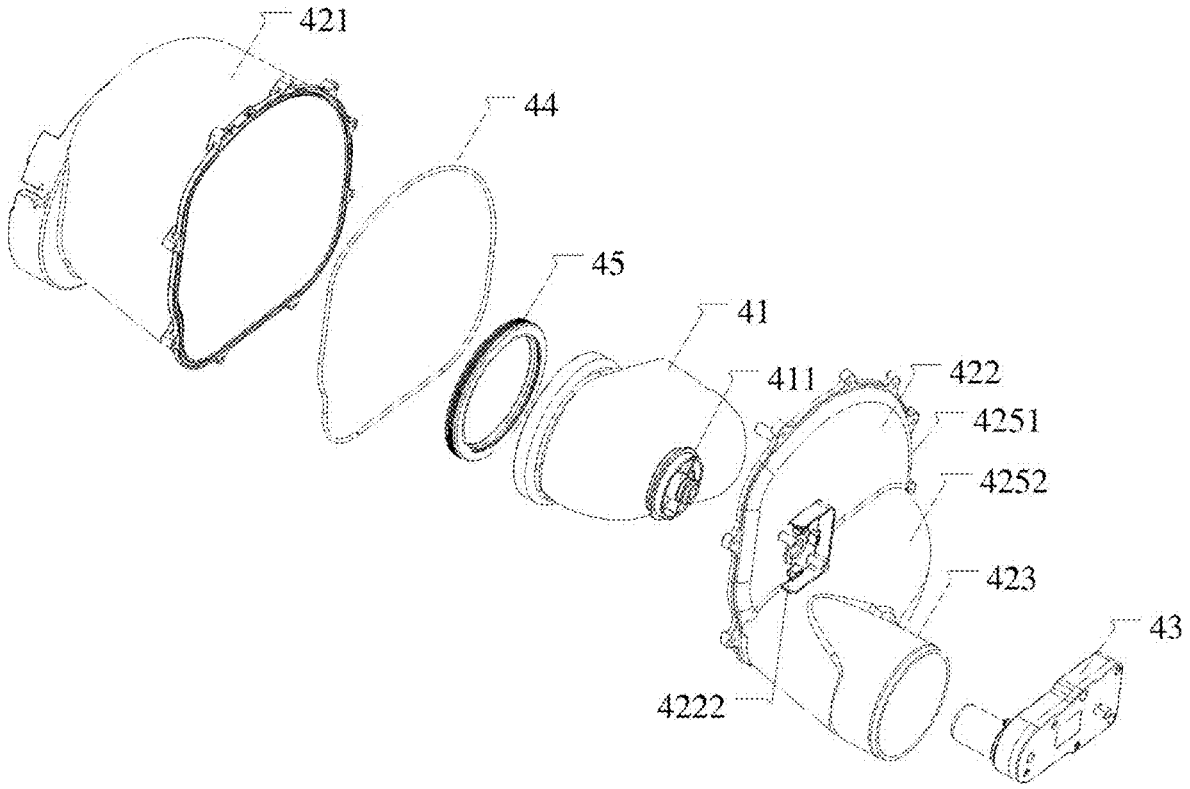
FIG. 14 is a schematic diagram of an exploded structure of the drain device shown in FIG. 13.

In an exemplary embodiment, as shown in FIGS. 13 and 14, the bowl 31 is provided with a first sewage outlet 34, and one end of the rotary drain pipe 41 communicates with the first sewage outlet 34. The drain device 4 further includes a drain box 42 at least partially located in the mounting cavity 32 and fixedly connected to the toilet body 3. The drain box 42 is provided with a rotary connection hole 4211 and a second sewage outlet 4221. The drain box 42 is provided with a drain cavity 424 (as shown in FIG. 9) communicating with the rotary connection hole 4211, and the rotary drain pipe 41 is at least partially located in the drain cavity 424 and rotates about the rotary connection hole 4211. The second sewage outlet 4221 communicates with the in-wall drain pipe 2.

The drain device 4 further includes a drain box 42 provided with a rotary connection hole 4211 for rotary connection to the rotary drain pipe 41. A sewage inlet of the rotary drain pipe 41 communicates with the first sewage outlet 34 of the toilet body 3. A main body of the rotary drain pipe 41 is located in the drain cavity 424 and may rotate from top to bottom in the drain cavity 424. When draining, the sewage in the bowl 31 enters the rotary drain pipe 41, rotates downwards with the rotary drain pipe 41, is discharged from the rotary drain pipe 41 under the action of gravity, and is discharged into the in-wall drain pipe 2 through a second sewage outlet 4221.

According to the present scheme, the drain cavity 424 is provided by the drain box 42, which may prevent sewage from contacting the mounting cavity 32, thereby preventing sewage from leaking from the mounting cavity 32, and facilitating the mounting of other structures, such as a water inlet valve, in the mounting cavity 32.

In an exemplary embodiment, as shown in FIGS. 13 and 14, the drain device 4 further includes a driving device 43 connected to the rotary drain pipe 41 and configured to drive the rotary drain pipe 41 to rotate.

Provision of the driving device 43 (such as a motor) enables automatic rotation of the rotary drain pipe 41. Thus, as shown in FIGS. 9 and 10, when there is a need to discharge sewage, the driving device 43 may drive the rotary drain pipe 41 to rotate to a drain position so as to realize the drain process. When the sewage discharging is completed, the driving device 43 may drive the rotary drain pipe 41 to rotate reversely from the drain position to an initial position, so that a water seal may be formed in the bowl 31.

Figure 15:
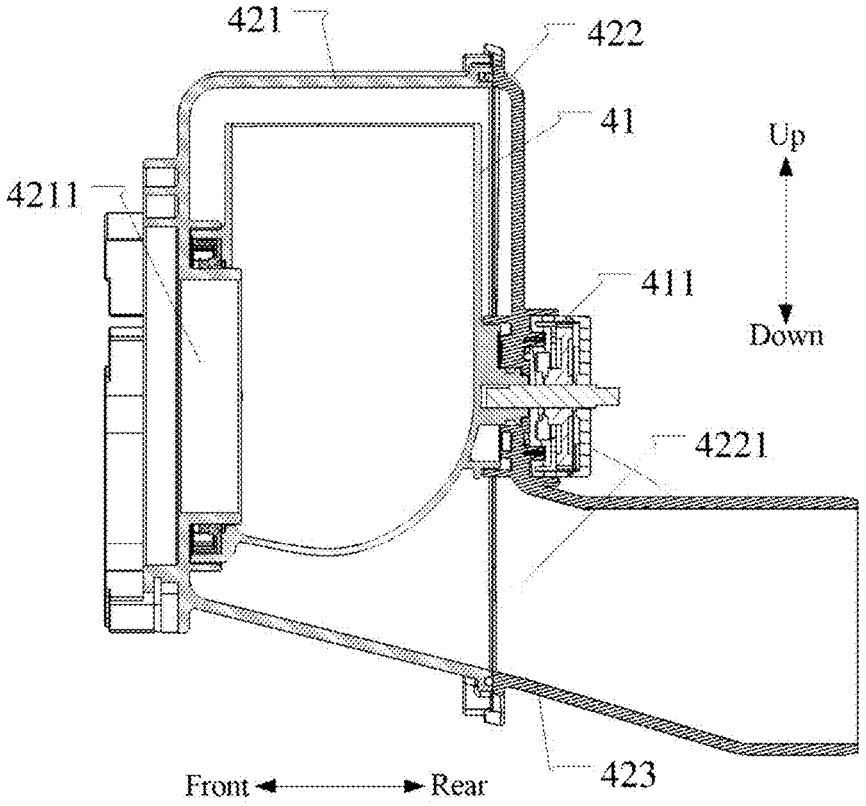
FIG. 15 is a schematic diagram of a cross-sectional structure of the drain device shown in FIG. 13.

The drain box 42 may be provided with a connection hole 4222, as shown in FIG. 14. The rotary drain pipe 41 may be provided with a connection portion 411, as shown in FIG. 15. The driving device 43 is connected to the connection portion 411 through the connection hole 4222 to drive the rotary drain pipe 41 to rotate.

In an exemplary embodiment, the wall-mounted toilet system further includes a control device electrically connected to the driving device 43 and configured to control the driving device 43 to work. In this way, the automatic control of the driving device 43 may be realized by the control device. The control device may further control a water outlet to automatically discharge water and automatically stop water, thereby realizing the intelligentization of the wall-mounted toilet system, which is conducive to further improving the user experience.

In an exemplary embodiment, a central axis of the sewage inlet of the rotary drain pipe 41 intersects, for example, vertically, a central axis of the sewage outlet. The rotary drain pipe 41 may be L-shaped or substantially L-shaped.

In an exemplary embodiment, as shown in FIG. 10, an inner wall surface of the drain cavity 424 is divided into a first region 425 and a second region 426 by taking a vertical plane where a central axis of the rotary connection hole 4211 is located as an interface 46, and the rotary drain pipe 41 rotates from a side where the second region 426 is located to a side where the first region 425 is located during a rotary drain process.

The second region 426 and the first region 425 are asymmetrically provided with respect to the interface 46, and a space enclosed by the first region 425 is larger than a space enclosed by the second region 426.

Since the rotary drain pipe 41 only needs to rotate to one side during the rotary drain process, that is, to the side where the first region 425 is located, as long as the side where the first region 425 is located has enough space, the rotation requirement of the rotary drain pipe 41 can be met. A space size of the second region 426 has no effect on the rotation requirement of the rotary drain pipe 41.

Based on this, the drain cavity 424 of the drain box 42 provided by this embodiment adopts an asymmetrically disposed irregular shape, and the first region 425 and the second region 426 are designed to be asymmetrically disposed. Further, the space enclosed by the first region 425 is relatively large to satisfy the rotation requirement of the rotary drain pipe 41, while the space enclosed by the second region 426 is relatively small. Compared with the scheme in which the drain cavity 424 is symmetrically arranged, the present scheme is equivalent to reducing the size of the second region 426, so that the space enclosed by the second region 426 is reduced, thereby reducing a volume of the drain cavity 424, reducing the demand for the assembly space of the drain box 42, and improving the adaptability and flexibility of the drain box 42.

In addition, the present scheme allocates the space of the drain cavity 424 mainly in the first region 425, so that an internal space of the drain cavity 424 is mainly used for drainage, thereby improving the space utilization rate in the drain box 42, increasing the available space for drainage, and reducing the probability of blockage.

The rotary drain pipe 41 may be completely located inside the drain box 42, so that the drain box 42 is fixedly connected to the toilet body 3, and the rotary drain pipe 41 is rotatably connected to the drain box 42. A sealing structure may be provided between the connection portions of the rotary drain pipe 41 and the drain box 42, and a sealing structure (such as an oil seal 45, as shown in FIG. 14) may be provided between the connection portions of the drain box 42 and the toilet body 3.

Alternatively, the rotary drain pipe 41 may be partially located within the drain box 42. For example, the drain box 42 is fixedly connected to the toilet body 3. A sewage inlet section of the rotary drain pipe 41 may extend out of the drain box 42 through the rotary connection hole 4211, and is inserted into the first sewage outlet 34 of the toilet body 3 to realize the communication with the first sewage outlet 34. The rotary drain pipe 41 may rotate relative to the toilet body 3 and the drain box 42.

In addition, the connection portion 411 of the rotary drain pipe 41 for connection to the driving device 43 may be located within the drain box 42, or may protrude out of the drain box 42.

When the rotary drain pipe 41 rotates from a side where the second region 426 is located to a side where the first region 425 is located during a rotary drain process, only a rotation direction (clockwise rotation or counterclockwise rotation) of the rotary drain pipe 41 during the rotational drain process is limited, but an initial drain position of the rotary drain pipe 41 is not limited. Since the rotary drain pipe 41 must rotate from top to bottom during a rotary drain process in order to discharge the sewage in the pipe by gravity, the rotational direction of the rotary drain pipe 41 may be determined based on the relative positions of the first region 425 and the second region 426. When in the initial position, the rotary drain pipe 41 may be in a vertical state, and the sewage outlet of the rotary drain pipe 41 may be partially located in a space on the side where the second region 426 is located, and partially located in a space on the side where the first region 425 is located. The rotary drain pipe 41 may also be in a slightly inclined state when in the initial position, and the sewage outlet of the rotary drain pipe 41 may be completely located in the space on the side where the first region 425 is located.

In an exemplary embodiment, as shown in FIG. 10, the first region 425 includes a transition region 4251 configured such that during a rotary drain process of the rotary drain pipe 41 relative to the drain box 42, a sewage outlet of the rotary drain pipe 41 faces the transition region 4251.

A distance between a central axis of the rotary connection hole 4211 and the transition region 4251 is gradually increased in a direction from top to bottom.

During the process of rotating the rotary drain pipe 41 to discharge sewage, as the rotary drain pipe 41 rotates from top to bottom, the sewage in the rotary drain pipe 41 will gradually be discharged, and a discharge speed will become faster and faster, and a throwing distance will become farther and farther. Therefore, when the distance between the central axis of the rotary connection hole 4211 and the transition region 4251 is gradually increased in the direction from top to bottom, a distance between the sewage outlet of the rotary drain pipe 41 and a cavity wall of the drain cavity 424 is also gradually increased during the rotary drain process. It is conducive to reducing the probability that the sewage discharged from the rotary drain pipe 41 is thrown on the cavity wall of the drain cavity 424, so that the sewage directly falls with little contact or even no contact with the cavity wall of the drain cavity 424 as much as possible, thereby reducing the sewage remaining or hanging on the cavity wall of the drain cavity 424, improving the cleanliness and hygiene of the drain box 42, and improving the user experience.

In an exemplary embodiment, a rotational angle of the rotary drain pipe 41 is less than 180° from the initial position to the drain position, as may be seen from the comparison between FIG. 9 and FIG. 10.

Compared with the rotational angle of the rotary drain pipe 41 being greater than or equal to 180°, on the one hand, the present scheme is conducive to reducing the rotation time of the rotary drain pipe 41, so as to achieve the purpose of rapid sewage discharging, on the other hand, it is also conducive to reducing the demand for the rotational space of the rotary drain pipe 41, which in turn is conducive to reducing a volume of the drain cavity 424 and miniaturizing the drain box 42, thereby improving the flexibility and adaptability of the drain box 42.

Figure 17:
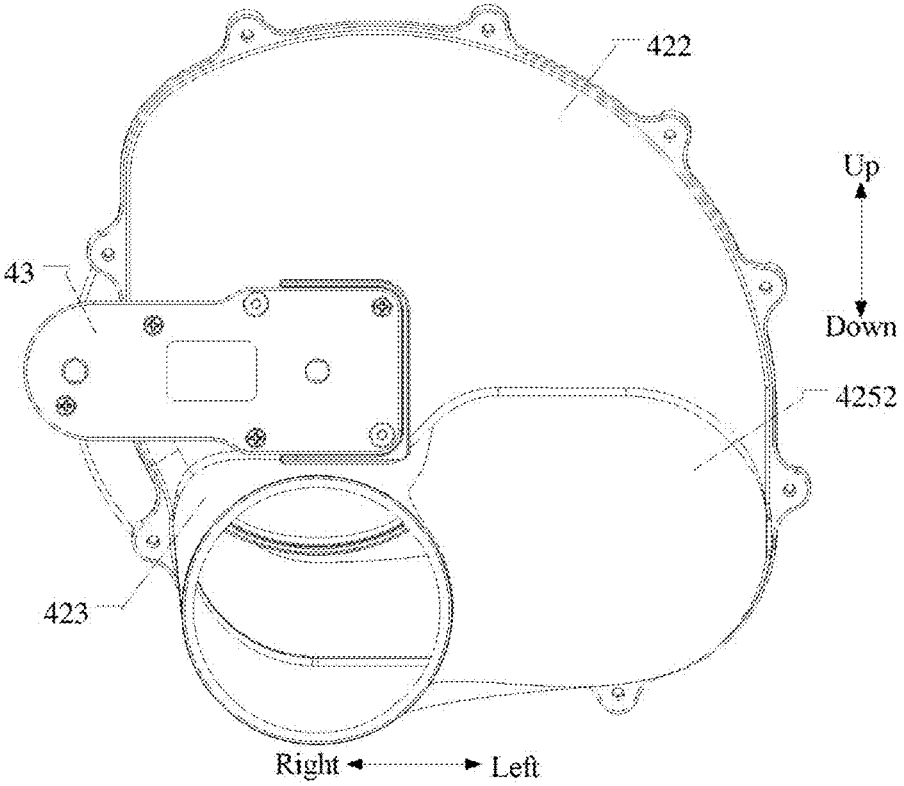
FIG. 17 is a schematic rear view of a structure of the drain device shown in FIG. 13.

In an exemplary embodiment, a central axis of the second sewage outlet 4221 is located on the interface 46. The first region 425 further includes an expansion region 4252 located below the transition region 4251, as shown in FIGS. 10, 14, and 17. The expansion region 4252 is raised in a direction close to the wall-mounted bracket 1.

Since the first sewage outlet 34 is usually located in a center position in a width direction of the toilet body 3, when the central axis of the second sewage outlet 4221 is located on the interface 46 (that is, when it is coplanar with the central axis of the first sewage outlet 34), the second sewage outlet 4221 is also located in the center position in the width direction of the toilet body 3, so that the in-wall drain pipe 2 may also be located in the center position in the width direction of the toilet body 3, which is consistent with a conventional wall-mounted toilet. Therefore, the wall-mounted bracket 1, the fake wall, and the in-wall drain pipe 2 may all adopt the design of the conventional wall-mounted toilet, which is conducive to popularization.

Provision of the expansion region 4252 facilitates the sewage discharged by the rotary drain pipe 41 to quickly divert and flow to the second sewage outlet 4221, and then smoothly enter the in-wall drain pipe 2, thereby preventing the sewage from accumulating or even blocking.

In an example, as shown in FIG. 15, a bottom wall of the expansion region 4252 is provided to be inclined downwardly in a direction close to the second sewage outlet 4221, which also facilitates the rapid flow of the sewage to the second sewage outlet 4221 under the action of gravity, and further discharge into the in-wall drain pipe 2.

In an exemplary embodiment, the drain box 42 includes a box body 421 and a box cover 422, as shown in FIGS. 13 and 14.

The box body 421 is located in the mounting cavity 32. One end of the box body 421 is provided with a rotary connection hole 4211, as shown in FIG. 15, and the other end of the box body 421 is provided as an open end. The box cover 422 is located in the mounting cavity 32, is provided to cover the open end of the box body 421, encloses and forms the drain cavity 424 with the box body 421, and is provided with the second sewage outlet 4221.

In this way, it facilitates the assembly between the rotary drain pipe 41 and the drain box 42, facilitates the simplification of the respective structures of the box body 421 and the box cover 422, and facilitates processing and shaping.

Figure 16:
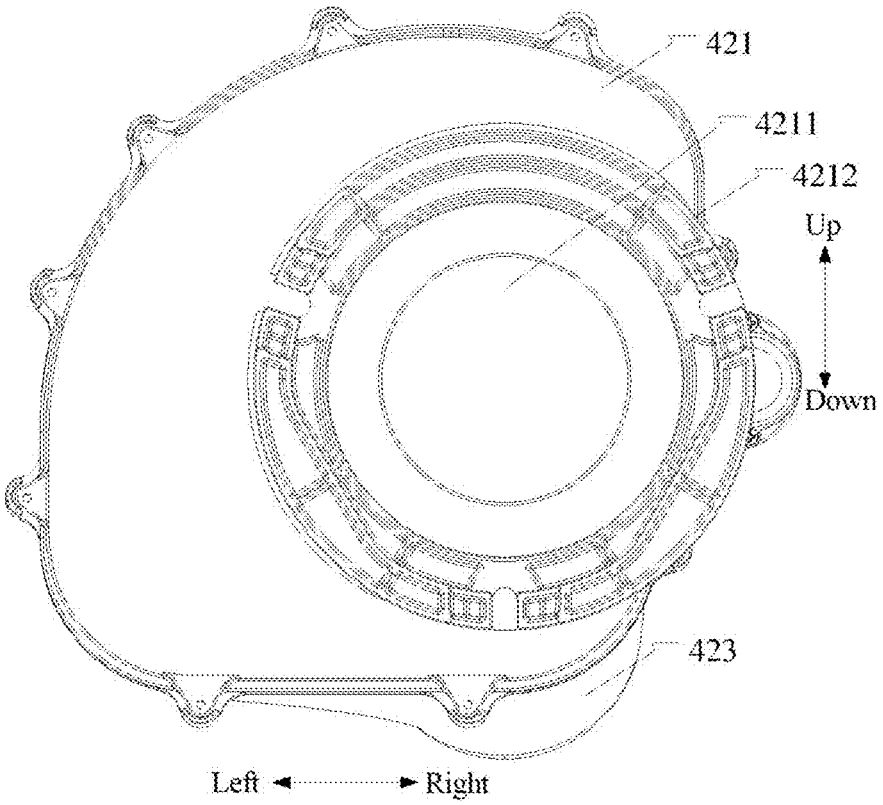
FIG. 16 is a schematic front view of a structure of the drain device shown in FIG. 13.
Figure 18:
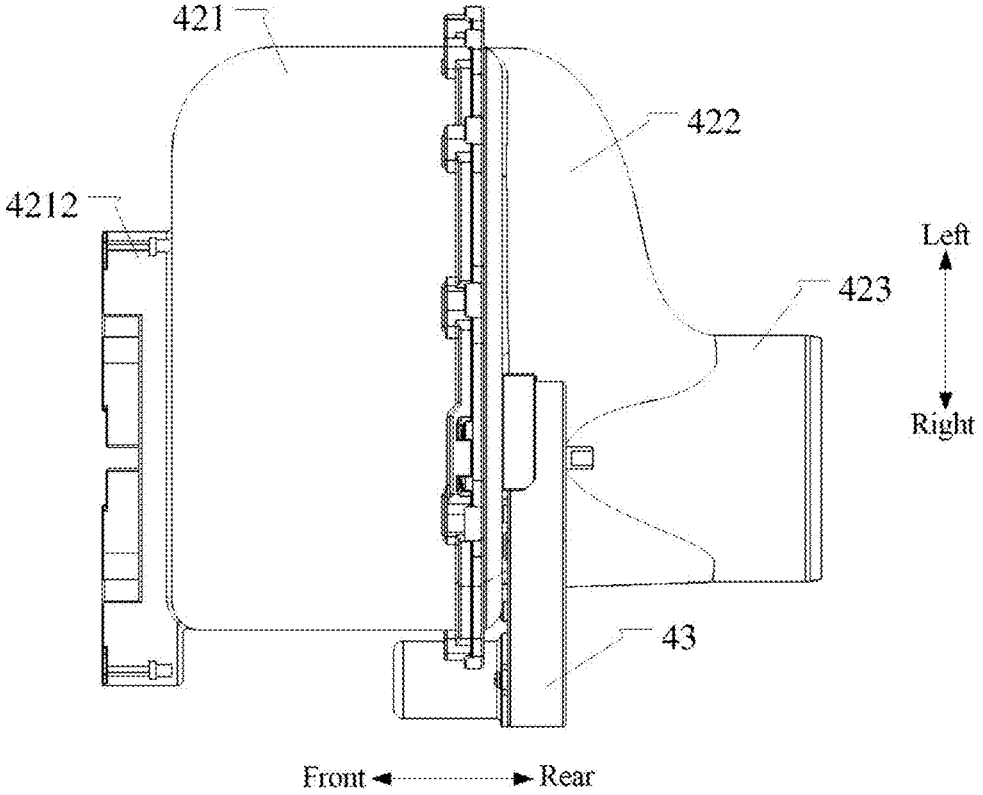
FIG. 18 is a schematic top view of a structure of the drain device shown in FIG. 13.
Figure 19:
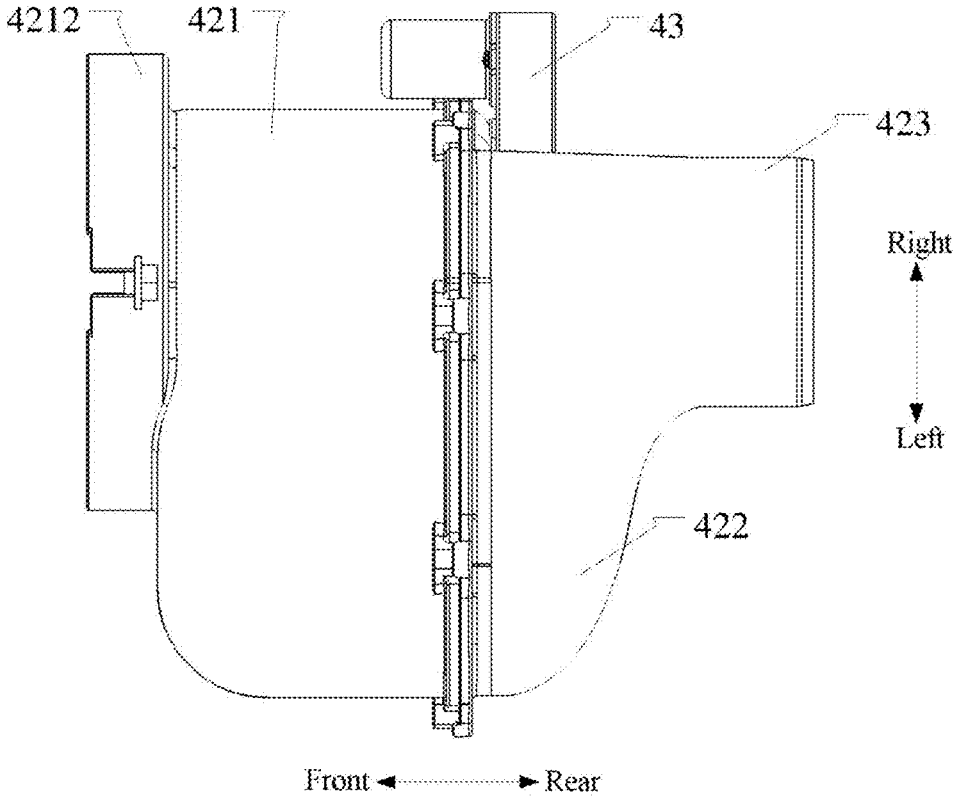
FIG. 19 is a schematic bottom view of a structure of the drain device shown in FIG. 13.
Figure 20:
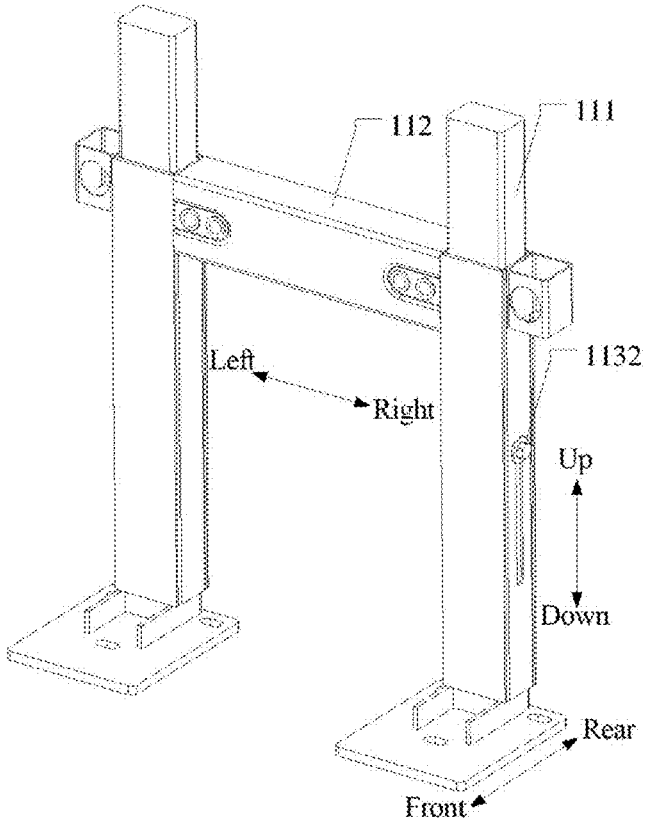
FIG. 20 is a schematic diagram of a three-dimensional structure of a bracket body of a wall-mounted bracket provided by an embodiment of the present disclosure.

In an example, an annular fixing portion 4212 is provided to protrude from a front end of the box body 421, as shown in FIGS. 16, 18 and 19. The fixing portion 4212 is sleeved on a protruding edge provided at the first sewage outlet 34 of the toilet body 3, and an oil seal 45 is provided between the fixing portion 4212 and the protruding edge. The fixing portion 4212 is also fixedly connected to the toilet body 3 by a fastener such as a screw. An annular flange is further provided in the box body 421. An inlet end of the rotary drain pipe 41 is sleeved on the annular flange and rotatably connected to the annular flange, and an oil seal 45 is provided between the rotary drain pipe 41 and the annular flange.

A sealing ring 44 is provided between the box cover 422 and the box body 421 to prevent leakage between the box cover 422 and the box body 421.

Figure 7:
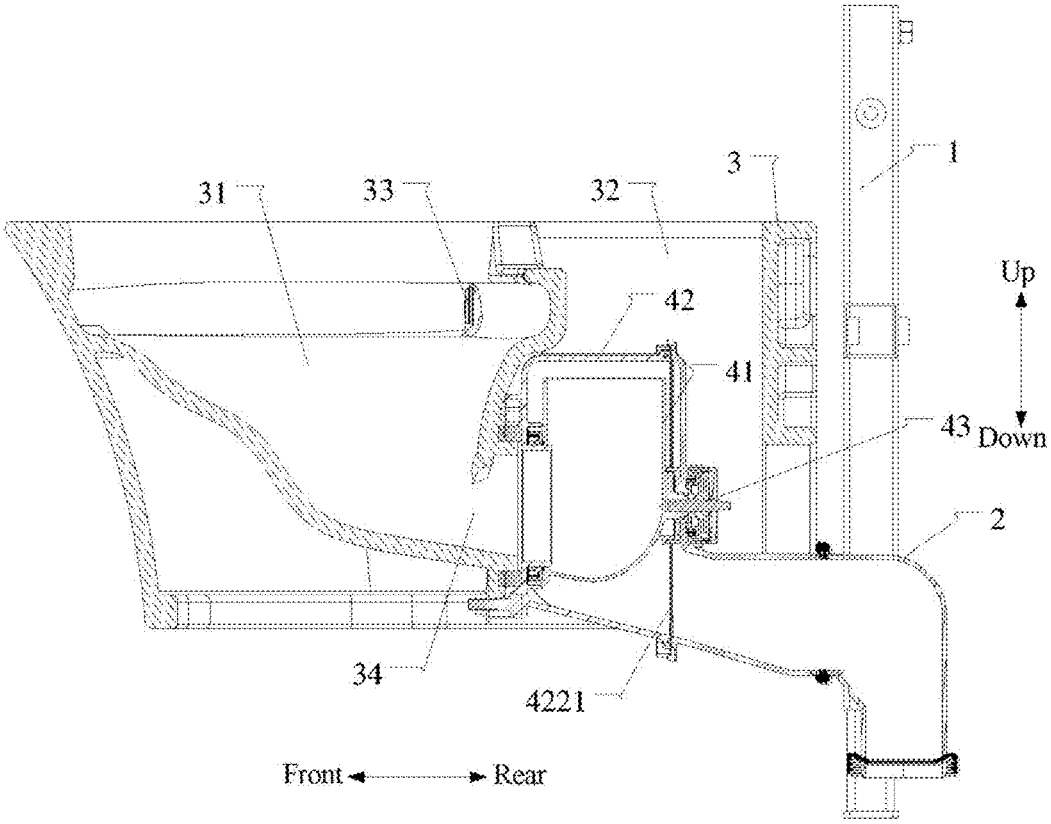
FIG. 7 is a schematic diagram of a cross-sectional structure of the wall-mounted toilet system shown in FIG. 1.

In an exemplary embodiment, the drain box 42 further includes an extension pipe 423, as shown in FIGS. 14 and 15. The extension pipe 423 is located at least partially within the mounting cavity 32, as shown in FIGS. 7 and 8. The extension pipe 423 is fixedly connected to the box cover 422, and one end of the extension pipe 423 communicates with the second sewage outlet 4221, and the other end of the extension pipe 423 communicates with the in-wall drain pipe 2.

Thus, position of the drain cavity 424 and position of the in-wall drain pipe 2 may be arranged reasonably according to the needs, without affecting the communication between the drain cavity 424 and the in-wall drain pipe 2.

The extension pipe 423 and the box cover 422 may be integrally formed.

In an example, a bottom wall of the extension pipe 423 is provided to be inclined downwardly in a direction close to the in-wall drain pipe 2, as shown in FIG. 15, so that sewage may smoothly enter the in-wall drain pipe 2 under the action of gravity, thereby avoid accumulation and blockage of the sewage.

In an example, the box cover 422 is provided with a connection hole 4222 through which a driving device 43 is connected to the rotary drain pipe 41, and the driving device 43 may be fixed to the box cover 422. The driving device 43 is located above the extension pipe 423.

In an exemplary embodiment, the bowl 31 is provided with a water outlet 33 located at a top portion of the bowl 31, as shown in FIG. 1, and the water outlet 33 is configured to connect to an external water source.

Figure 12:
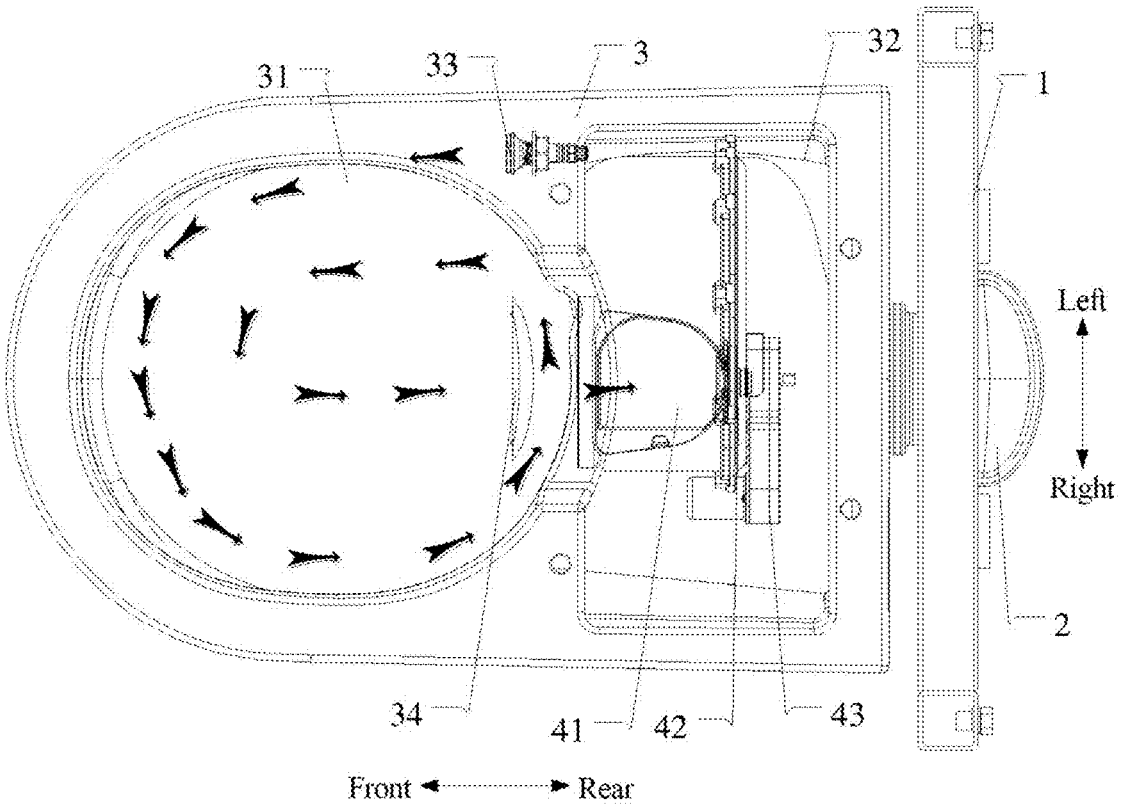
FIG. 12 is a schematic top view of a structure of the wall-mounted toilet system shown in FIG. 1 in a water replenishment state.

The water outlet 33 of the toilet body 3 is used for supplying water to the bowl 31, as shown in FIGS. 11 and 12, to flush the bowl 31 and to ensure formation of a water seal in the bowl 31. The first sewage outlet 34 of the toilet body 3 is used to discharge the sewage in the bowl 31.

The water outlet 33 is provided at the top portion of the bowl 31, that is, the water outlet 33 is a ring washing port. Moreover, the water outlet 33 may be connected to an external water source, such as tap water, so that the water flowing out of the water outlet 33 may flush the inner wall of the bowl 31, replenish the water in the bowl 31, form a water seal in the bowl 31, and provide water for discharging sewage. In this way, the injection port and pressurization device of the conventional wall-mounted toilet may be omitted, thereby reducing the noise of the toilet. In addition, the water tank of the conventional wall-mounted toilet may also be omitted, thereby simplifying the structure of the wall-mounted toilet system and reducing production costs and maintenance costs.

In an exemplary embodiment, the wall-mounted bracket 1 includes a bracket body 11, as shown in FIGS. 20 to 24.

The bracket body 11 is provided with floor connecting portions (first connection holes 1115 as described below) and toilet connecting portions (second connection holes 1127 as described below). The floor connecting portions are provided to be connected to a floor 52 so that the bracket body 11 is fixed to the floor 52. The toilet connecting portions are provided to be connected to the toilet body 3 so that the toilet body 3 is fixed to the bracket body 11.

The toilet connecting portions of the support body 11 are used to realize the connection between the wall-mounted bracket 1 and the toilet body 3. The floor connecting portions are used to realize the connection between the wall-mounted bracket 1 and the floor 52. In this way, the wall-mounted bracket 1 may be fixed to the floor 52 to play a major supporting role for the entire wall-mounted toilet system by the ground, so that the wall-mounted toilet system provided by the embodiment of the present disclosure may also be mounted on a non-load-bearing wall, thereby expanding the range of use of the product.

In this embodiment, as shown in FIGS. 27 to 30, the wall-mounted bracket 1 is embedded in a wall 51. The floor 52 refers to a structure having a certain thickness connected to a lower end of the wall 51, which may include, for example, structures such as reinforced concrete, bricks, and floor slabs. After the wall-mounted toilet system is mounted, the wall-mounted bracket 1 is concealed inside the wall 51, the toilet body 3 is placed outside the wall 51, and the floor connecting portions are connected to the floor 52 at the lower end of the wall 51.

In an exemplary embodiment, as shown in FIGS. 20 to 24, the bracket body 11 includes a fixing frame 111, a movable frame 112, and a locking member.

The floor connecting portions are provided at a bottom of the fixing frame 111. The movable frame 112 is connected to the fixing frame 111 and may move up and down relative to the fixing frame 111. The toilet connecting portions are provided on the movable frame 112. The locking member is provided to be fixedly connected to the movable frame 112 and the fixing frame 111 to fix the movable frame 112 to the fixing frame 111.

During assembly, the fixing frame 111 is fixed to the floor 52, and the movable frame 112 may be moved up and down as required. When moved to a desired height, the movable frame 112 is locked by the locking member, and then the toilet body 3 is fixedly connected to the movable frame 112.

In the present scheme, a height of the wall-mounted bracket 1 may be adjusted, which facilitates the adjustment of the wall mounting height of the toilet body 3 as required, showing a high compatibility.

In an exemplary embodiment, as shown in FIGS. 21, 22, 23 and 24, the movable frame 112 includes a first vertical support arm 1121, a second vertical support arm 1122, and a transverse support arm 1123. The second vertical support arm 1122 is provided opposite the first vertical support arm 1121. The transverse support arm 1123 is located between the first vertical support arm 1121 and the second vertical support arm 1122, and is fixedly connected to the first vertical support arm 1121 and the second vertical support arm 1122. The toilet connecting portions are provided on the transverse support arm 1123.

The fixing frame 111 includes a third vertical support arm 1111, a fourth vertical support arm 1112, a first support plate 1113, and a second support plate 1114. The third vertical support arm 1111 is provided opposite the fourth vertical support arm 1112. The first support plate 1113 is connected to a lower end of the third vertical support arm 1111. The second support plate 1114 is connected to a lower end of the fourth vertical support arm 1112. The first support plate 1113 and the second support plate 1114 are provided with floor connecting portions.

The first vertical support arm 1121 is movable up and down relative to the third vertical support arm 1111 and is connected to the third vertical support arm 1111 by the locking member. The second vertical support arm 1122 is movable up and down relative to the fourth vertical support arm 1112 and is connected to the fourth vertical support arm 1112 by the locking member.

In this embodiment, the first vertical support arm 1121, the second vertical support arm 1122, and the transverse support arm 1123 are connected to form an H-shaped structure. The third vertical support arm 1111 is connected to the first support plate 1113, and the fourth vertical support arm 1112 is connected to the second support plate 1114, forming a structure similar to two legs. Compared with other more complex scheme designs, the structure of the present scheme is relatively simple, which is convenient for processing and shaping, and is also conducive to saving raw materials, thereby reducing the production and processing cost of the wall-mounted bracket 1.

The toilet body 3 of a conventional wall-mounted toilet is usually connected to the wall-mounted bracket 1 through a plurality of connection holes arranged horizontally at intervals. Therefore, by providing the toilet connecting portions on the transverse support arm 1123 of the movable frame 112, the wall-mounted bracket 1 and the toilet body 3 may be connected in a conventional manner, thereby avoiding excessive modification of the toilet body 3, and facilitating the popularization and use of the wall-mounted bracket 1. The first support plate 1113 and the second support plate 1114 may fit against the floor 52 and play a better supporting role, so the floor connecting portions are provided on the first support plate 1113 and the second support plate 1114.

Since the first vertical support arm 1121 may have a role in supporting the toilet body 3, and the third vertical support arm 1111 may have a role in supporting the first vertical support arm 1121, the third vertical support arm 1111 may indirectly have a role in supporting the toilet body 3. Therefore, the first vertical support arm 1121 and the third vertical support arm 1111 may play a dual supporting role for the toilet body 3.

Similarly, since the second vertical support arm 1122 may have a role in supporting the toilet body 3, and the fourth vertical support arm 1112 may have a role in supporting the second vertical support arm 1122, the fourth vertical support arm 1112 may indirectly have a role in supporting the toilet body 3. Therefore, the second vertical support arm 1122 and the fourth vertical support arm 1112 may play a dual supporting role for the toilet body 3, which is conducive to improving the fixing reliability of the wall-mounted toilet system.

In an exemplary embodiment, as shown in FIGS. 21 to 24, the first vertical support arm 1121 and the second vertical support arm 1122 are both of hollow tubular structures. The first vertical support arm 1121 is movably sleeved outside the third vertical support arm 1111, and the second vertical support arm 1122 is movably sleeved outside the fourth vertical support arm 1112.

Figure 22:
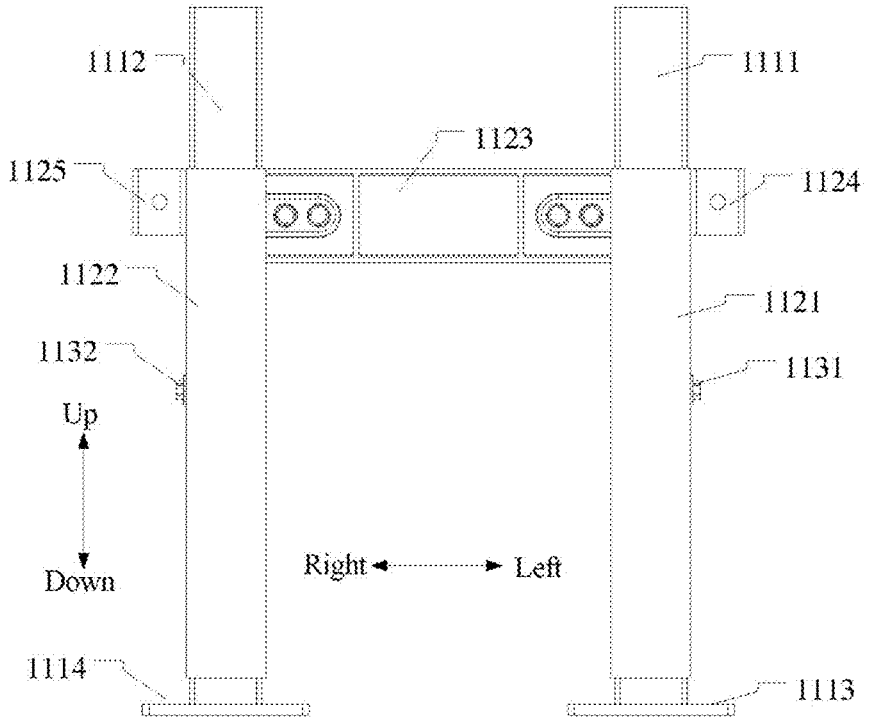
FIG. 22 is a schematic rear view of a structure of the bracket body shown in FIG. 20.
Figure 23:
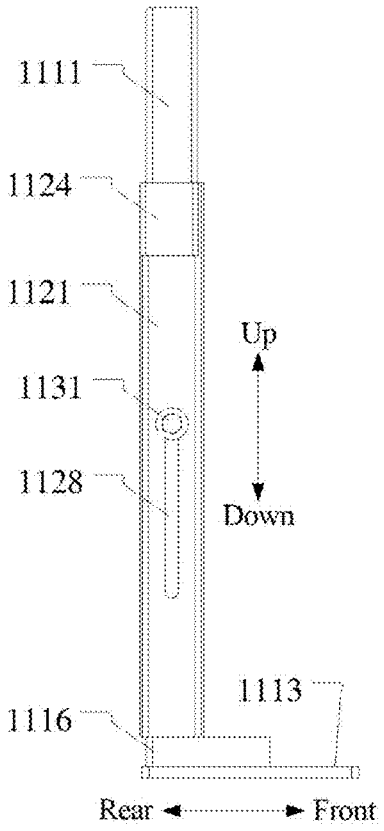
FIG. 23 is a schematic left view of a structure of the bracket body shown in FIG. 20.

The first vertical support arm 1121 and the second vertical support arm 1122 are each provided with an adjustment hole 1128, as shown in FIG. 23. The third vertical support arm 1111 and the fourth vertical support arm 1112 are each provided with a fixing hole. The locking member includes a first fastener 1131 and a second fastener 1132, as shown in FIGS. 20 to 24.

The first fastener 1131 is inserted through the adjustment hole 1128 of the first vertical support arm 1121 and the fixing hole of the third vertical support arm 1111 to fixedly connect the first vertical support arm 1121 to the third vertical support arm 1111. The second fastener 1132 is inserted through the adjustment hole 1128 of the second vertical support arm 1122 and the fixing hole of the fourth vertical support arm 1112 to fixedly connect the second vertical support arm 1122 to the fourth vertical support arm 1112.

In the present scheme, the third vertical support arm 1111 and the fourth vertical support arm 1112 may function as a movement guide. In the assembly process, after moving the movable frame 112 up and down to a desired height, the movable frame 112 may be locked by installing the first fastener 1131 and the second fastener 1132, and the assembly process is simple and fast. The first fastener 1131 and the second fastener 1132 may be adjustment bolt sets.

The adjustment hole 1128 may be an obround hole extending in a vertical direction, thereby facilitating the realization of infinite adjustment of the height. There may be a plurality of adjustment holes 1128 provided at intervals in a vertical direction. There may be one fixing hole, or a plurality of fixing holes provided at intervals in a height direction.

Alternatively, the third vertical support arm 1111 may be sleeved outside the first vertical support arm 1121, and the fourth vertical support arm 1112 may be sleeved outside the second vertical support arm 1122, and positions of the adjustment holes 1128 and the fixing holes may be interchanged accordingly.

In an exemplary embodiment, the fixing frame 111 further includes a first set of limiting plates and a second set of limiting plates.

As shown in FIGS. 21 to 24, the first set of limiting plates is provided on the first support plate 1113 and located below the first vertical support arm 1121. The first set of limiting plates includes a first vertical plate 1116 and a second vertical plate 1117 provided opposite each other. The first vertical plate 1116 and the second vertical plate 1117 are respectively provided on both sides of the third vertical support arm 1111 in a width direction of the fixing frame 111, and are fixedly connected to the third vertical support arm 1111.

The second set of limiting plates is provided on the second support plate 1114, and located below the second vertical support arm 1122. The second set of limiting plates includes a third vertical plate 1118 and a fourth vertical plate 1119 provided opposite each other. The third vertical plate 1118 and the fourth vertical plate 1119 are respectively provided on both sides of the fourth vertical support arm 1112 in the width direction of the fixing frame 111, and are fixedly connected to the fourth vertical support arm 1112.

Thus, the first set of limiting plates and the second set of limiting plates may abut against lower ends of the movable frame 112 to define a limit position where the movable frame 112 moves downwards, which may prevent the movable frame 112 from occupying an excessive area of the first support plate 1113 and the second support plate 1114 due to direct abut against the two support plates, so that the two support plates have sufficient area to facilitate the reasonable arrangement of the floor connecting portions on the first support plate 1113 and the second support plate 1114.

Figure 24:
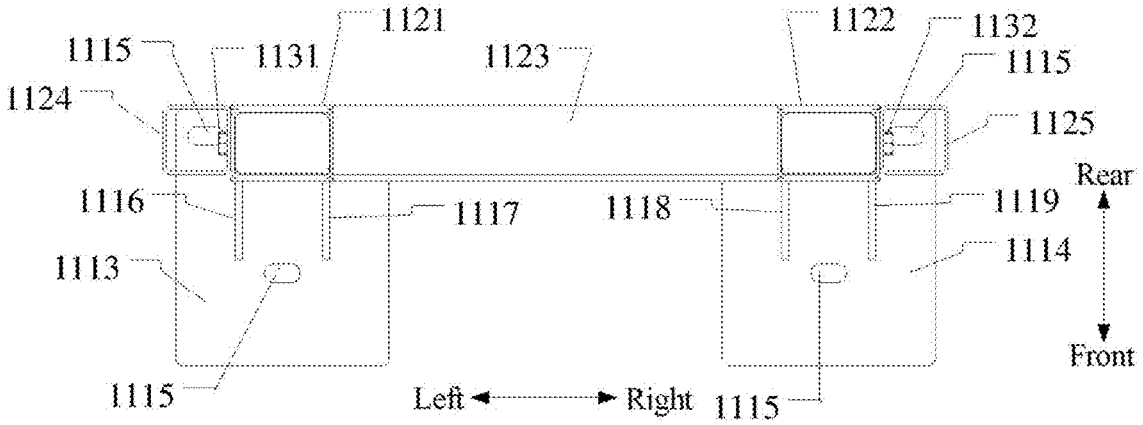
FIG. 24 is a schematic top view of a structure of the bracket body shown in FIG. 20.

In an exemplary embodiment, as shown in FIGS. 22, 23 and 24, the movable frame 112 further includes a first stiffening portion 1124 and a second stiffening portion 1125. The first stiffening portion 1124 is provided on a side of the first vertical support arm 1121 away from the transverse support arm 1123, and is fixedly connected to the first vertical support arm 1121. The second stiffening portion 1125 is provided on a side of the second vertical support arm 1122 away from the transverse support arm 1123, and is fixedly connected to the second vertical support arm 1122.

The first stiffening portion 1124 and the second stiffening portion 1125 are provided with wall connecting portions. The wall connecting portions are configured to be connected to the wall 51 so that the bracket body 11 is fixed to the wall 51.

In this way, the connection of the wall-mounted bracket 1 to the floor 52 plays a major fixing role. The wall-mounted bracket 1 may further be connected to the wall 51 to play an auxiliary fixing role, which is conducive to further improving the fixing reliability of the wall-mounted toilet system.

Figure 21:
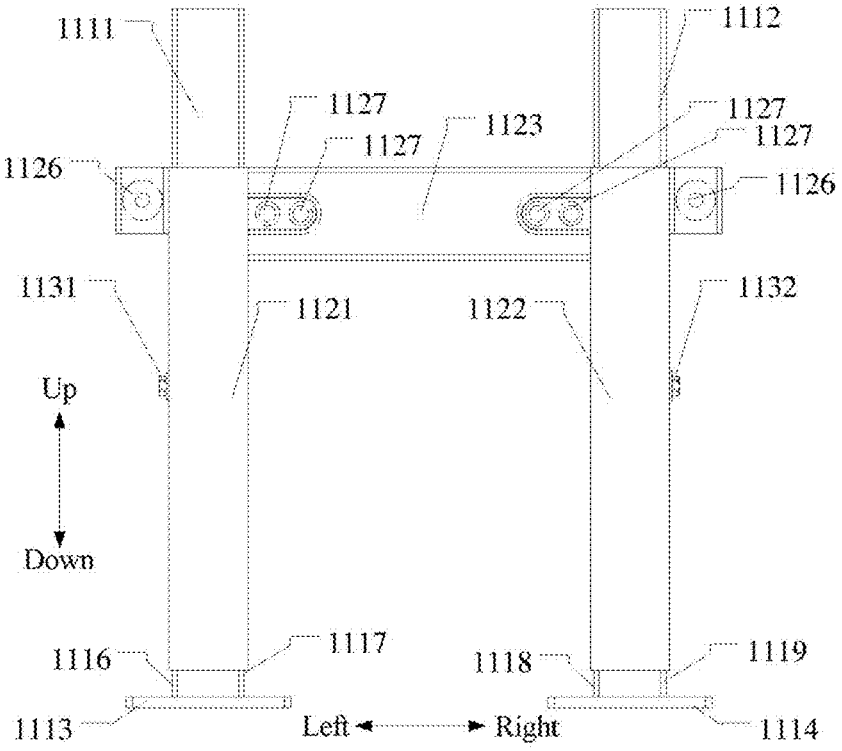
FIG. 21 is a schematic front view of a structure of the bracket body shown in FIG. 20.

The wall connecting portions may include bolt holes 1126, as shown in FIG. 21, for mounting wall expansion bolts to reliably connect the wall-mounted bracket 1 to the wall 51.

In an exemplary embodiment, as shown in FIG. 24, the floor connecting portions include two sets of first connection holes provided at intervals in a width direction of the bracket body 11.

The two sets of first connection holes may be symmetrically provided left and right, which is conducive to the balanced force distribution on the wall-mounted bracket 1.

In an exemplary embodiment, each set of first connection holes includes three first connection holes 1115 arranged in a triangle, as shown in FIG. 24.

In this way, the arrangement of the first connection holes 1115 in a triangle enables the fixation to be relatively stable, which is conducive to ensuring that the two sets of first connection holes have a better fixation effect on the bracket body 11.

In an example, as shown in FIG. 24, one set of first connection holes is provided on the first support plate 1113. One of the first connection holes 1115 is located between the first vertical plate 1116 and the second vertical plate 1117, and the other two first connection holes 1115 are located outside the first vertical plate 1116 and the second vertical plate 1117, and are located directly below the movable frame 112. The other set of first connection holes is provided on the second support plate 1114. One of the first connection holes 1115 is located between the third vertical plate 1118 and the fourth vertical plate 1119, and the other two first connection holes 1115 are located outside the third vertical plate 1118 and the fourth vertical plate 1119, and are located directly below the movable frame 112.

Alternatively, each set of first connection holes may include only one first connection hole 1115. The first connection hole 1115 may be used to mount a foot expansion bolt 12.

Alternatively, the floor connecting portions are not limited to the first connection hole 1115 described above, and may include, for example, a connection post, a clamp hook, a clamp hole, or other structures.

In an exemplary embodiment, as shown in FIG. 21, the toilet connecting portions include at least two second connection holes 1127 provided at intervals in a width direction of the bracket body 11.

For a conventional wall-mounted toilet, the toilet body 3 is usually fixedly connected to the wall-mounted bracket 1 by two fasteners. Therefore, the present scheme provides two second connection holes 1127, which may realize the fixed connection between the toilet body 3 and the bracket body 11, and conforms to the conventional mounting habit, and may also reduce the modification of the toilet body 3.

Figure 25:
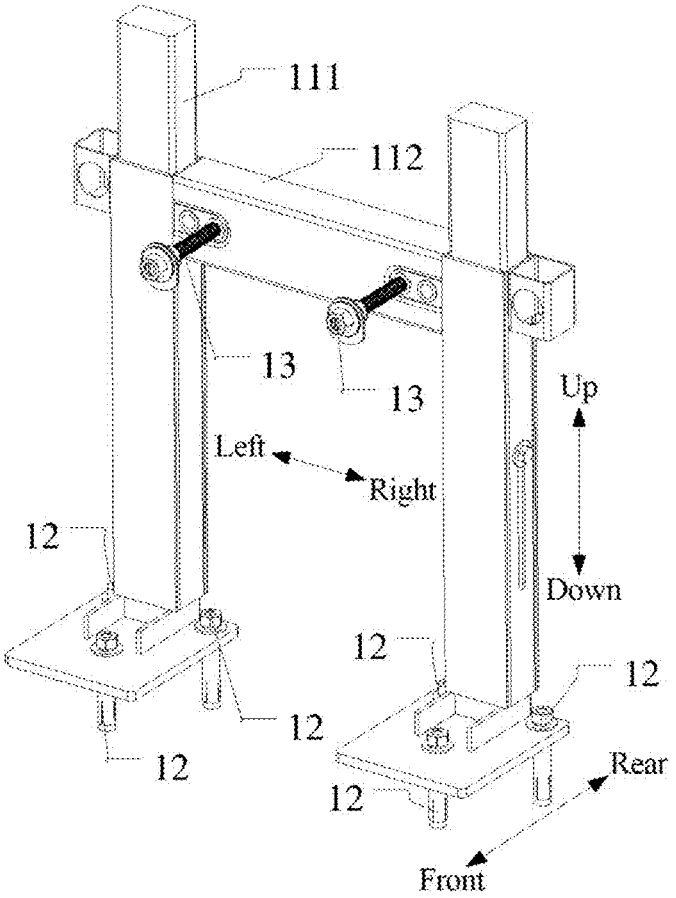
FIG. 25 is a schematic diagram of a three-dimensional structure of a wall-mounted bracket provided by an embodiment of the present disclosure.
Figure 26:
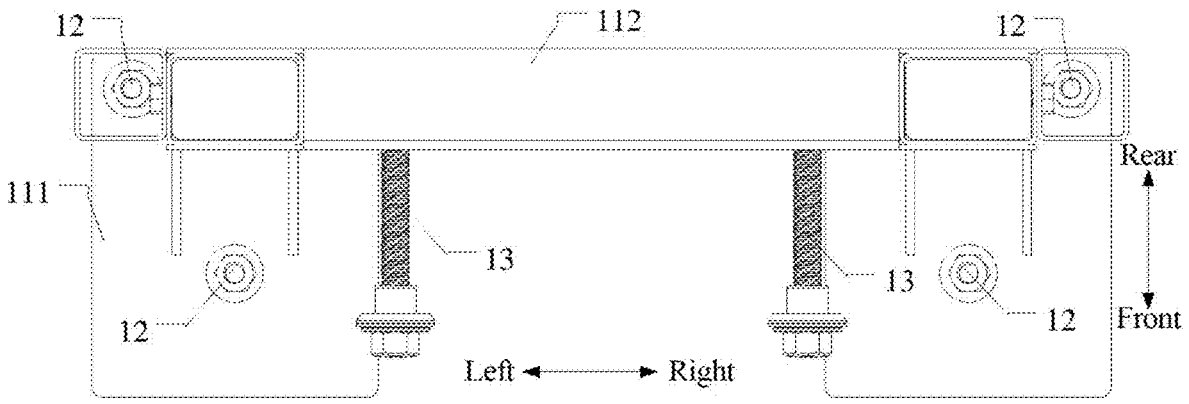
FIG. 26 is a schematic top view of a structure of the wall-mounted bracket shown in FIG. 25.
Figure 27:
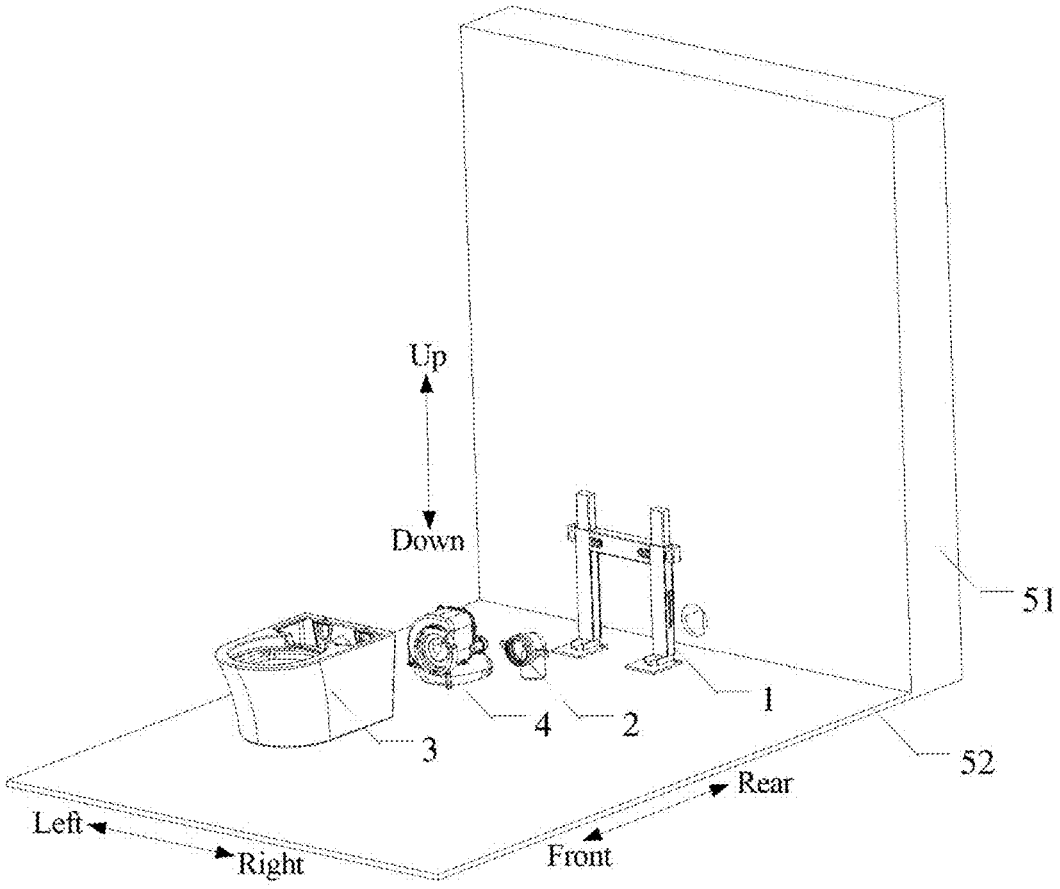
FIG. 27 is a schematic assembly diagram of a wall-mounted toilet system provided by an embodiment of the present disclosure.
Figure 28:
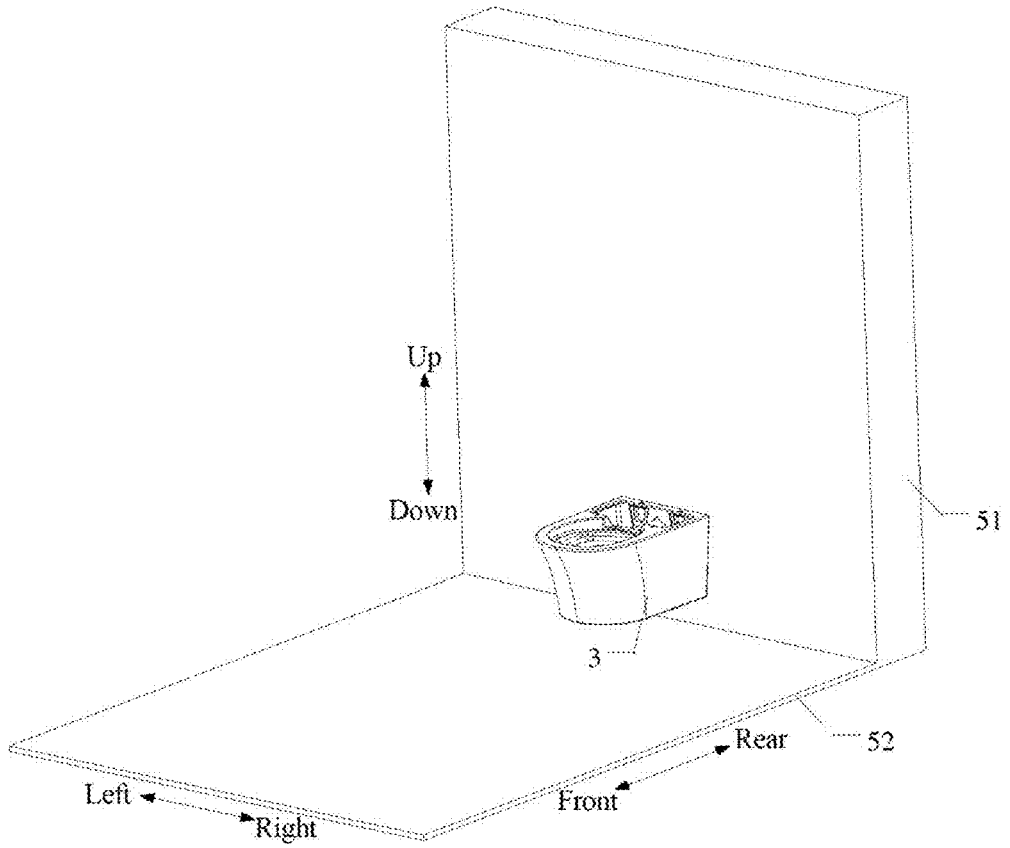
FIG. 28 is a schematic diagram of the wall-mounted toilet system shown in FIG. 27 after completion of assembly.
Figure 29:
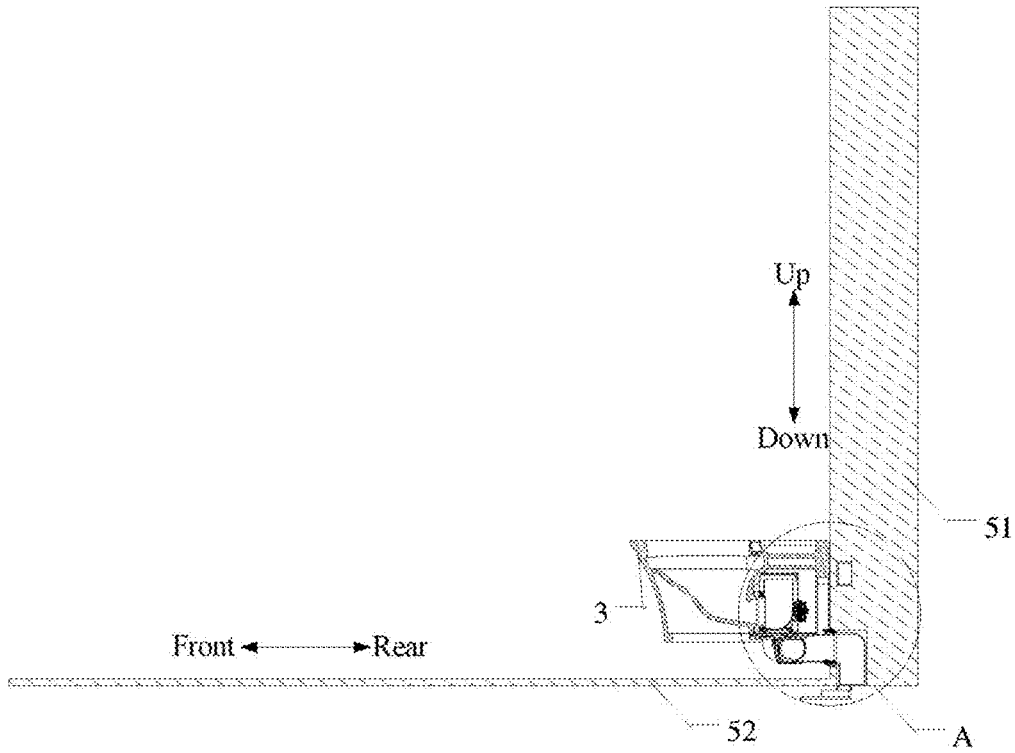
FIG. 29 is a schematic diagram of a cross-sectional structure of the wall-mounted toilet system shown in FIG. 28 after being assembled.
Figure 30:
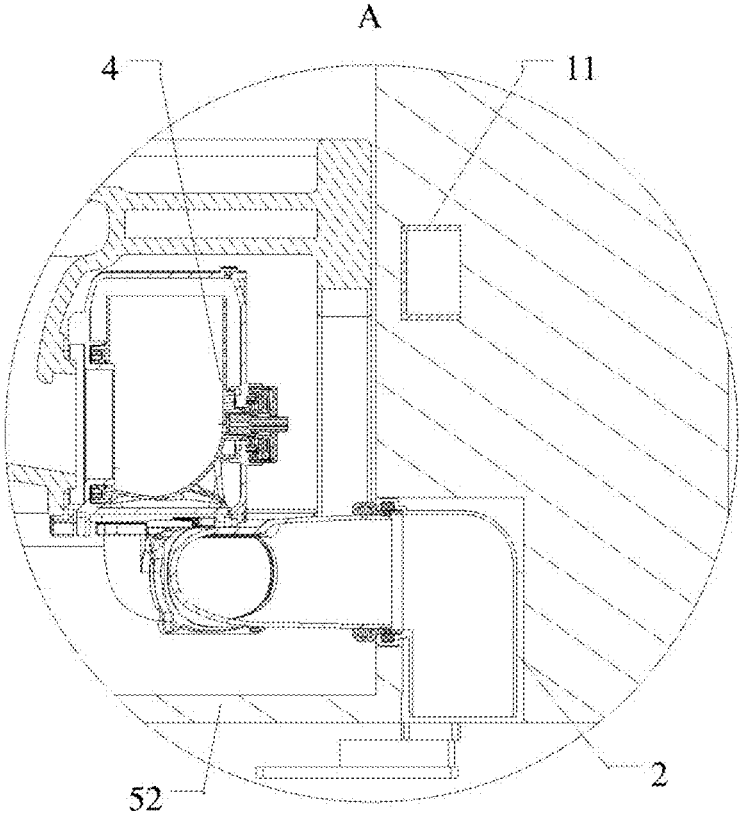
FIG. 30 is an enlarged schematic diagram of a structure of part A in FIG. 29.

The second connection holes 1127 may be used to mount fixing bolts 13, as shown in FIGS. 25 and 26. The fixing bolts 13 are used to realize the fixing connection between the toilet body 3 and the bracket body 11, with high connection strength and relatively reliable fixation.

Alternatively, a quantity of the second connection holes 1127 may also be three, four or even more. In this way, the connection strength between the toilet body 3 and the bracket body 11 is higher, and the fixation is more reliable.

Some of the second connection holes 1127 may also be used as spare connection holes. For example, the quantity of the second connection holes 1127 is four, but only two of the second connection holes 1127 are used to mount the fixing bolts 13, as shown in FIGS. 20, 21, 25 and 26.

The toilet connecting portions are not limited to the form of the second connection holes 1127 described above, and may include, for example, a connection post, a clamp hook, a clamp hole, or other structures.

In the description of the embodiments of the present disclosure, it should be noted that the orientation or position relationships indicated by the terms "upper", "lower", "one side", "the other side", "one end", "the other end", "side", "relative", "corners", "periphery" and "square structure" or the like are based on the orientation or position relationships shown in the drawings, which are only for convenience of describing the embodiments of the present disclosure and simplifying the description, rather than indicating or implying that the structure referred has the specific orientation, or is constructed and operated in the specific orientation, and thus cannot be interpreted as a limitation on the present disclosure.

In the description of embodiments of the present disclosure, unless otherwise explicitly specified and limited, the terms "connection", "direct connection", "indirect connection", "fixed connection", "installation" and "assembly" should be broadly understood, for example, they may be fixed connection, detachable connection or integrated connection. The terms "installation", "connection" and "fixed connection" may be direct connection, or indirect connection through an intermediate medium, or the internal communication between two elements. For those ordinarily skilled in the art, meanings of the above terms in the embodiments of the present disclosure may be understood according to situations.

Although the implementations of embodiments of the present disclosure are disclosed above, the described contents are only the implementations adopted for facilitating understanding of the present disclosure, which are not intended to limit the present disclosure. Any person skilled in the art to which the present disclosure pertains may make any modification and variation in implementation forms and details without departing from the spirit and scope disclosed in the present disclosure. However, the scope of patent protection of the present disclosure is still subject to the scope defined by the appended claims.

The invention claimed is:

1. A wall-mounted toilet system, comprising:

a wall-mounted bracket and an in-wall drain pipe;

a toilet body, which is fixed to the wall-mounted bracket and is provided with a bowl and a mounting cavity; and a drain device, which is connected to the toilet body, communicates with the in-wall drain pipe, and comprises a rotary drain pipe provided within the mounting cavity, wherein one end of the rotary drain pipe communicates with the bowl, and the rotary drain pipe is configured to rotate relative to the toilet body between an initial position and a drain position, such that when the rotary drain pipe rotates to the initial position, a water seal is formed in the bowl, and when the rotary drain pipe rotates to the drain position, sewage in the bowl is discharged into the in-wall drain pipe, wherein the bowl is provided with a first sewage outlet, and one end of the rotary drain pipe communicates with the first sewage outlet;

the drain device further comprises a drain box at least partially located within the mounting cavity and fixedly connected to the toilet body, wherein the drain box is provided with a rotary connection hole and a second sewage outlet, the drain box is provided with a drain cavity communicating with the rotary connection hole, and the rotary drain pipe is at least partially located within the drain cavity and rotates about the rotary connection hole; and the second sewage outlet communicates with the in-wall drain pipe;

an inner wall surface of the drain cavity is divided into a first region and a second region by taking a vertical plane where a central axis of the rotary connection hole is located as an interface, and the rotary drain pipe rotates from a side where the second region is located to a side where the first region is located during a rotary drain process;

the first region comprises a transition region configured such that during a rotary drain process of the rotary drain pipe relative to the drain box, a sewage outlet of the rotary drain pipe faces the transition region; and a central axis of the second sewage outlet is located on the interface, the first region further comprises an expansion region located below the transition region, and the expansion region extends rearwardly from the transition region towards the wall-mounted bracket.

2. The wall-mounted toilet system according to claim 1, wherein the drain device further comprises:

a driving device connected to the rotary drain pipe and configured to drive the rotary drain pipe to rotate.

3. The wall-mounted toilet system according to claim 1, wherein the mounting cavity is located between the bowl and the wall-mounted bracket.

4. The wall-mounted toilet system according to claim 1, wherein a top portion of the bowl is provided with a water outlet, and the water outlet is configured to connect to an external water source.

5. The wall-mounted toilet system according to claim 1, wherein, the second region and the first region are asymmetrically provided with respect to the interface, and a space enclosed by the first region is larger than a space enclosed by the second region.

6. The wall-mounted toilet system according to claim 5, wherein, a distance between a central axis of the rotary connection hole and the transition region is gradually increased in a direction from top to bottom.

7. The wall-mounted toilet system according to claim 6, wherein, a rotational angle of the rotary drain pipe is less than 180° when rotating from the initial position to the drain position.

8. The wall-mounted toilet system according to claim 7, wherein, a bottom wall of the expansion region is provided to be inclined downwardly in a direction close to the in-wall drain pipe.

9. The wall-mounted toilet system according to claim 1, wherein the drain box comprises:

a box body, which is located within the mounting cavity, wherein one end of the box body is provided with the rotary connection hole, and the other end of the box body is provided as an open end; and a box cover, which is located within the mounting cavity, is configured to cover the open end of the box body, encloses and forms the drain cavity with the box body, and is provided with the second sewage outlet.

10. The wall-mounted toilet system according to claim 9, wherein the drain box further comprises:

an extension pipe located at least partially within the mounting cavity and fixedly connected to the box cover, wherein one end of the extension pipe communicates with the second sewage outlet, and the other end of the extension pipe communicates with the in-wall drain pipe.

11. The wall-mounted toilet system according to claim 10, wherein a bottom wall of the extension pipe is provided to be inclined downwardly in a direction towards the in-wall drain pipe.

12. The wall-mounted toilet system according to claim 1, wherein the wall-mounted bracket comprises:

a bracket body provided with floor connecting portions and toilet connecting portions, wherein the floor connecting portions are provided to be connected to a floor so that the bracket body is fixed to the floor, and the toilet connecting portions are provided to be connected to the toilet body so that the toilet body is fixed to the bracket body.

13. The wall-mounted toilet system according to claim 12, wherein the floor connecting portions comprise two sets of first connection holes provided at intervals in a width direction of the bracket body, and/or wherein the toilet connecting portions comprise at least two second connection holes, wherein the two second connection holes are provided at intervals in a width direction of the bracket body.

14. The wall-mounted toilet system according to claim 12, wherein the bracket body comprises:

a fixing frame, wherein the floor connecting portions are provided at a bottom of the fixing frame;

a movable frame connected to the fixing frame and capable of moving up and down relative to the fixing frame, wherein the toilet connecting portions are provided on the movable frame; and a locking member provided to be fixedly connected to the movable frame and the fixing frame to fix the movable frame to the fixing frame.

15. The wall-mounted toilet system according to claim 14, wherein, the movable frame comprises a first vertical support arm, a second vertical support arm, and a transverse support arm; the second vertical support arm is provided opposite the first vertical support arm; the transverse support arm is located between the first vertical support arm and the second vertical support arm, and is fixedly connected to the first vertical support arm and the second vertical support arm; and the toilet connecting portions are provided on the transverse support arm;

the fixing frame comprises a third vertical support arm, a fourth vertical support arm, a first support plate, and a second support plate; the third vertical support arm is provided opposite the fourth vertical support arm; the first support plate is connected to a lower end of the third vertical support arm; the second support plate is connected to a lower end of the fourth vertical support arm; and the first support plate and the second support plate are provided with the floor connecting portions; and the first vertical support arm is movable up and down relative to the third vertical support arm, and is connected to the third vertical support arm by the locking member; and the second vertical support arm is movable up and down relative to the fourth vertical support arm, and is connected to the fourth vertical support arm by the locking member.

16. The wall-mounted toilet system according to claim 15, wherein, the movable frame further comprises a first stiffening portion and a second stiffening portion; the first stiffening portion is provided on a side of the first vertical support arm away from the transverse support arm, and is fixedly connected to the first vertical support arm; the second stiffening portion is provided on a side of the second vertical support arm away from the transverse support arm, and is fixedly connected to the second vertical support arm; and the first stiffening portion and the second stiffening portion are provided with wall connecting portions configured to be connected to a wall so that the bracket body is fixed to the wall.

17. The wall-mounted toilet system according to claim 15, wherein, the first vertical support arm and the second vertical support arm are both of hollow tubular structures, the first vertical support arm is movably sleeved outside the third vertical support arm, and the second vertical support arm is movably sleeved outside the fourth vertical support arm;

the first vertical support arm and the second vertical support arm are each provided with an adjustment hole, and the third vertical support arm and the fourth vertical support arm are each provided with a fixing hole; and the locking member comprises a first fastener and a second fastener; the first fastener is inserted through the adjustment hole of the first vertical support arm and the fixing hole of the third vertical support arm to fixedly connect the first vertical support arm to the third vertical support arm; and the second fastener is inserted through the adjustment hole of the second vertical support arm and the fixing hole of the fourth vertical support arm to fixedly connect the second vertical support arm to the fourth vertical support arm.

18. The wall-mounted toilet system according to claim 17, wherein, the fixing frame further comprises a first set of limiting plates and a second set of limiting plates;

the first set of limiting plates is provided on the first support plate and located below the first vertical support arm, and the first set of limiting plates comprises a first vertical plate and a second vertical plate provided opposite each other; and the first vertical plate and the second vertical plate are respectively provided on both sides of the third vertical support arm in a width direction of the fixing frame, and are fixedly connected to the third vertical support arm; and the second set of limiting plates is provided on the second support plate and located below the second vertical support arm, and the second set of limiting plates comprises a third vertical plate and a fourth vertical plate provided opposite each other; and the third vertical plate and the fourth vertical plate are respectively provided on both sides of the fourth vertical support arm in the width direction of the fixing frame, and are fixedly connected to the fourth vertical support arm.

* * * * *